US006952540B2

(12) United States Patent
Uchiyama

(10) Patent No.: US 6,952,540 B2
(45) Date of Patent: Oct. 4, 2005

(54) IMAGE FORMING APPARATUS

(75) Inventor: Akihiko Uchiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/210,063

(22) Filed: Aug. 2, 2002

(65) Prior Publication Data

US 2003/0035659 A1 Feb. 20, 2003

(30) Foreign Application Priority Data

Aug. 10, 2001 (JP) ..... 2001-244421
Dec. 19, 2001 (JP) ..... 2001-386038

(51) Int. Cl.[7] ..... G03G 15/20; G03G 15/08
(52) U.S. Cl. ..... 399/69; 399/53
(58) Field of Search ..... 399/53, 67, 69, 399/70, 76, 320, 328, 329

(56) References Cited

U.S. PATENT DOCUMENTS 5,508,796 A 4/1996 Sasame et al.
5,523,829 A 6/1996 Miyashiro et al.
5,666,597 A 9/1997 Sasame et al. ..... 399/128
5,768,654 A * 6/1998 Noguchi et al. ..... 399/69
5,847,361 A * 12/1998 Yonekawa et al. ..... 219/216
5,999,787 A * 12/1999 Finsterwalder et al. ..... 399/329
6,038,412 A * 3/2000 Hiraoka ..... 399/69
6,298,213 B1 * 10/2001 Miyamoto et al. ..... 399/320

FOREIGN PATENT DOCUMENTS

JP 51-109739 1/1975
JP 62-116960 5/1987

* cited by examiner

*Primary Examiner*—Sandra L. Brase
(74) *Attorney, Agent, or Firm*—Fitzpatrick, Cella, Harper & Scinto

(57) ABSTRACT

In an image forming apparatus, a first sequence group operates after input of a print signal and a second sequence group is started up at timing when a temperature T of a fixing device has reached a certain temperature T1 after the input of the print signal or timing for which a temperature rising curve is calculated from a time for the temperature T to reach a certain temperature T2 from the temperature T1 during temperature rising of the fixing device. With this image forming apparatus, it becomes possible to reduce unnecessary operations of a developing device and a photosensitive drum and extend a usable life of the developing device even if image formation and temperature rising of the fixing device are performed in parallel.

40 Claims, 19 Drawing Sheets

IMAGE FORMING APPARATUS

BACKGROUND OF THE INVENTION

1. Field of the Invention

The present invention relates to an image forming apparatus for forming and bearing an unfixed toner image on a material to be recorded with a transfer system or a direct system like electrofax by an appropriate image forming process such as an electrophotographic process, electrostatic recording process and a magnetic recording process and fixing the unfixed toner image on the material to be recorded by heat-fixing means.

2. Related Background Art

As fixing means in an image forming apparatus using an electrophotographic process, a fixing device of a film heating system has been put to practical use in response to a demand for energy saving. In the fixing device of the film heating system, a thin film having heat resistance is nipped between a ceramic heater as heat generating means and a pressure roller as a pressuring member to form a fixing nip. The fixing device applies heat and pressure to a material to be recorded while conveying the material to be recorded by rotating both the film and the pressure roller, thus fixing the unfixed toner image thereon.

In this fixing device of the film heating system, since a heat capacity of a film functioning as a member to be heated is extremely small compared with a conventional fixing device of a heat roller system, thermal energy from the heat generating means can be used efficiently in a fixing process. Consequently, a quick start is possible which can reduce a waiting time from the input of a power supply of the image forming apparatus to a printable state. Moreover, since the heat capacity of the member to be heated is small and it is unnecessary to preheat the member to be heated during print standby, power consumption of the image forming apparatus can be controlled to be low and energy saving is possible.

As a higher efficiency fixing device of a film heating system, there is proposed a fixing device of an electromagnetic induction heating system for causing a conductive film itself to generate heat. Japanese Utility Model Application Laid-Open No. 51-109739 discloses a fixing device for inducing an eddy current to a metal film by an alternating magnetic field and causing the metal film to generate heat by Joule heat. Since it is possible to cause the film itself to generate heat in the electromagnetic induction heating system, thermal energy from heat generating means can be used more efficiently in a fixing process.

Such a fixing device of the film heating system by a heater or the film heating system by electromagnetic induction can be warmed up to a fixable temperature in sixty seconds or less and is called a quick start fixing device.

When it is attempted to reduce a time from the start of printing until the end of discharge of a printed transferring material (first printout time; hereinafter referred to as FPOT) making use of the characteristics of the quick start fixing device as described above, it is necessary to anticipate a temperature rising state of the fixing device and perform image formation in parallel with the temperature rising of the fixing device such that the transferring material reaches the fixing device when the temperature rising of the fixing device is completed.

However, in such a case, for example, where an image forming apparatus is placed under a low temperature environment or where a voltage of a power supply to the image forming apparatus has dropped to a lower limit value, temperature of the fixing device may not be able to completely rise in an assumed time. Thus, if timing is set with a margin of time from the start of printing until the start of fixing taking into account a worst condition, the FPOT is prolonged even under a normal condition.

SUMMARY OF THE INVENTION

The present invention has been devised in view of the above and other drawbacks, and it is an object of the present invention to provide an image forming apparatus provided with a heat-fixing device, which can perform image formation and temperature rising of the fixing device in parallel in order to make FPOT shortest and can perform temperature rising of the fixing device appropriately without imposing any load to components of the image forming apparatus even if the temperature rising of the fixing device is not in time for the image formation.

In order to attain the above-mentioned object, the image forming apparatus of the present invention is an image forming apparatus provided with fixing means for heat-fixing a toner image formed on a transferring material and detecting means for detecting a temperature of the fixing means, the image apparatus being characterized by comprising a first sequence group including control for at least fixing temperature control that operates after input of a print signal and a second sequence group whose timing of starting an operation is determined based on a temperature of the fixing means after a predetermined time from the input of the print signal.

The second sequence group preferably includes control for rotation of a developing roller, rotation of a photosensitive drum or application of a charging bias.

The image forming apparatus may be a color image forming apparatus for forming a color image by performing charging, exposure and development for a plurality of times.

The fixing means is preferably a quick start fixing device with a short warm-up time.

The fixing means is preferably started to be heated simultaneously with print start.

The fixing device is preferably preheated prior to print start.

In the image forming apparatus in accordance with the present invention, in particular, the image forming apparatus provided with the quick start fixing device, image formation and temperature rising of the fixing device are performed in parallel in order to make FPOT shortest and, if the temperature rising of the fixing device is not in time for the image formation, image forming operations such as the rotation of the developing roller and the rotation of the photosensitive drum are performed after the fixing device has reached a predetermined temperature. Thus, the temperature rising of the fixing device can be performed appropriately without affecting usable lives of components of the image forming apparatus such as a developing device and the photosensitive drum.

In addition, a relationship between a heating time and a temperature of the fixing device (temperature rising curve) varies depending on an environment in which the image forming apparatus is placed or a power supply voltage to be supplied. In FIG. 19, "a" is a temperature rising curve of the fixing device at the time when temperature rising has started from a room temperature, and "b" is a temperature rising curve of the fixing device at the time when temperature rising has started from a room temperature in a state in which the power supply voltage is at a lower limit. Moreover, T1 is a threshold temperature for starting up the second sequence, and T2 is a fixable temperature at which a toner image can be fixed properly. In this figure, for example, when a temperature of the fixing device is judged at a time t1, since the temperature exceeds the threshold value T1 on both "a" and "b", the second sequence can be started up. However, since a temperature of the fixing device at a time t2, when a material to be recorded reaches the fixing device, has reached T2 on "a" but has not reached T2 on "b", deficient fixing is likely to be caused on "b".

In this way, it is difficult in every situation to anticipate, based on a temperature of the fixing device after a predetermined time from input of a print signal, a temperature rising state thereafter. Thus, if the threshold value T1 is set rather large, a heating time of the fixing device is prolonged more than needed at the time of a normal power supply voltage or an upper limit power supply voltage, and the FPOT cannot be made shortest.

It is another object of the present invention to provide an image forming apparatus that is provided with a heat-fixing device and performs image formation and temperature rising of the fixing device in parallel, wherein FPOT becomes shortest by appropriately judging a temperature rising state of the fixing device in every situation and allowing a temperature of the fixing device to rise to an appropriate temperature in a shortest time.

In order to attain the above-mentioned object, the image forming apparatus of the present invention is an image forming apparatus provided with fixing means for heat-fixing a toner image formed on a material to be recorded and detecting means for detecting a temperature of the fixing means, the image forming apparatus being characterized by comprising a first sequence group including control for at least fixing temperature control that operates after input of a print signal and a second sequence group whose operation is started at the point when a temperature of the fixing means has reached a threshold temperature determined from a temperature rising situation of the fixing means.

The temperature rising situation of the fixing means is preferably represented by a time for a temperature of the fixing means to reach a second set temperature from a first set temperature or by a rate of change of temperature per unit time for a temperature of the fixing means to reach the second set temperature from the first set temperature.

The temperature rising situation of the fixing means is preferably represented by a temperature that has risen while the fixing means reaches a second set time from a first set time or by a rate of change of temperature per unit time for a temperature of the fixing means to reach the second set time from the first set time.

The second sequence group preferably includes control for rotation of a developing roller, rotation of an image bearing member or application of a charging bias.

The image forming apparatus may be a color image forming apparatus for forming a color image by performing charging, exposure and development for a plurality of times.

The fixing means is preferably a quick start fixing device in which a warm-up time from the start of temperature rising until a fixable temperature is forty seconds or less.

Heating of the fixing means is preferably started simultaneously with the input of a print signal.

That is, the present invention is an image forming apparatus consisting of a first sequence for controlling a temperature of the developing device and a second sequence for forming an image on a material to be recorded, wherein a temperature rising situation of the fixing means of the fixing device is detected to calculate a temperature rising curve and determine start-up timing of the second sequence, whereby a temperature rising state of the fixing device for determining the start-up timing of the second sequence can be accurately judged in every situation and FPOT always becomes shortest.

In the image forming apparatus in accordance with the present invention, in particular, the image forming apparatus that is provided with the quick start fixing device and performs image formation on a material to be recorded and temperature rising of the fixing device in parallel, a temperature rising state of the fixing device can be appropriately judged in every situation from a temperature rising curve of the fixing device. Thus, an image forming apparatus in which FPOT becomes shortest under every situation can be provided. In addition, since unnecessary heating of the fixing device can be controlled, the present invention is also effective for energy saving.

These and other objects and advantages of the invention may be readily ascertained by referring to the following description and accompanying drawings.

DESCRIPTION OF THE PREFERRED EMBODIMENTS

Preferred embodiments of the present invention will be hereinafter illustratively described in detail with reference to the accompanying drawings. Note that dimensions, materials, shapes, relative arrangement and the like of components described in the embodiments are not for limiting the scope of the present invention to such dimensions, materials, shapes, relative arrangement and the like unless otherwise described specifically.

First Embodiment

An image forming apparatus in accordance with a first embodiment of the present invention will be described with reference to FIGS. 1 to 6.

Overall Structure

First, an overall structure of the image forming apparatus will be briefly described with reference to FIG. 1.

Figure 1:
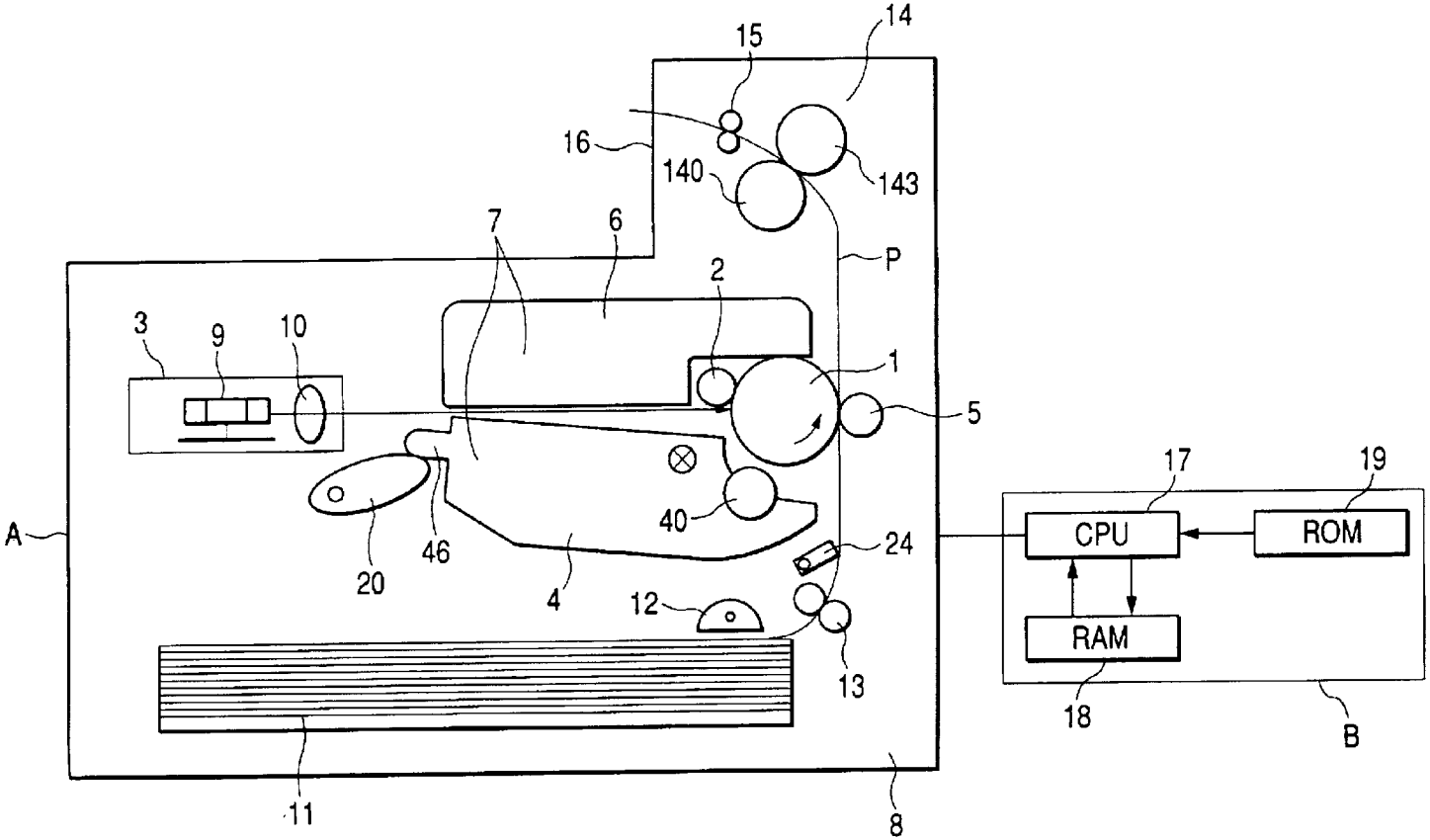
FIG. 1 is a vertical sectional view showing a schematic structure of an image forming apparatus in accordance with a first embodiment of the present invention.

FIG. 1 is a vertical sectional view showing an overall structure of a laser beam printer A that is a form of the image forming apparatus.

A photosensitive drum 1 as an image bearing body is driven to rotate counterclockwise by driving means (not shown) as indicted by an arrow in the figure. A charging device 2 for uniformly charging the surface of the photosensitive drum 1, a scanner unit 3 for irradiating a laser beam L based on image information to form an electrostatic latent image on the photosensitive drum 1, a developing device 4 for applying toner to the electrostatic latent image to develop it as a toner image, a transfer roller 5 for transferring the toner image on the photosensitive drum 1 to a transferring material P as a material to be recorded, a cleaning device 6 for removing transfer residual toner remaining on the surface of the photosensitive drum 1 after the transfer and the like are arranged around the photosensitive drum 1 in order in the direction of its rotation.

Here, the photosensitive drum 1, the charging device 2, the developing device 4 and the cleaning device 6 are integrated as a cartridge to form a process cartridge 7.

The scanner unit 3 is arranged substantially in a substantially horizontal direction of the photosensitive drum 1, and outputs the laser beam L as image light corresponding to an image signal by a laser diode (not shown) and irradiates the laser beam L on a polygon mirror 9 that is rotated at a high speed by a scanner motor (not shown). The laser beam L reflected from the polygon mirror 9 selectively scans and exposes the charged surface of the photosensitive drum 1 via an imaging lens 10 to form an electrostatic latent image.

As the transfer roller 5 that is arranged to be opposed to the photosensitive drum 1, for example, a core bar of metal covered by an elastic body such as ethylene-propylene-diene ternary copolymer (EPDM), urethane rubber or nitrile butadiene rubber (NBR) adjusted to have a volume resistance of approximately $10^7$ to $10^{11}$ Ω·cm can be used. A bias of a positive polarity is applied to the transfer roller 5 from a power supply (not shown), and a toner image of a negative polarity on the photosensitive drum 1 is transferred to the transferring material P, which is in contact with the photosensitive drum 1, by an electric field created by this bias.

A sheet feeding unit 8 is for feeding and conveying the transferring material P to an image forming unit, and a plurality of transferring materials P are contained in a sheet feeding cassette 11. When an image is formed, a sheet feeding roller 12 (hemispherical roller) and a registration roller pair 13 are driven to rotate in response to an image forming operation to separate and feed the transferring materials P in the sheet feeding cassette 11 individually. At the same time, the leading end of the transferring material P abuts the registration roller pair 13 to stop once to form a loop and thereafter, the transferring material P is fed to a nip formed by the transfer roller 5 and the photosensitive drum 1. Reference numeral 24 denotes a registration sensor. Image formation is performed with a point when a transferring material crosses the registration sensor as a reference. The fixing device 14 is a quick start fixing device of an electromagnetic induction heating system, which is for fixing a toner image transferred to the transferring material P and consists of a cylindrical fixing film 140 as a rotation body having a heat generating layer (conductive magnetic member) and a pressure roller 143 for pressing and contacting with the fixing film 140 to give heat and pressure to the transferring material P. A structure of the fixing device 14 will be described in detail later.

That is, the transferring material P having the toner image on the photosensitive drum 1 transferred thereon is conveyed by the fixing film 140 and the pressure roller 143 and, at the same time, is given heat and pressure when it passes through the fixing device 14. Consequently, the toner image is fixed on the surface of the transferring material P. The transferring material P having the toner image fixed thereon is discharged to the outside of a main body of the image forming apparatus from a sheet discharging portion 16 with an image surface facing down by a discharge roller pair 15.

A control device B is for controlling operations of the image forming apparatus A and has a CPU 17, a random access memory (RAM) 18 and a read only memory (ROM) 19. A program for controlling the image forming apparatus and various data are written in the ROM 19, and the RAM 18 is used for saving of retrieved data, or the like in controlling the image forming apparatus.

Process Cartridge

Figure 2:
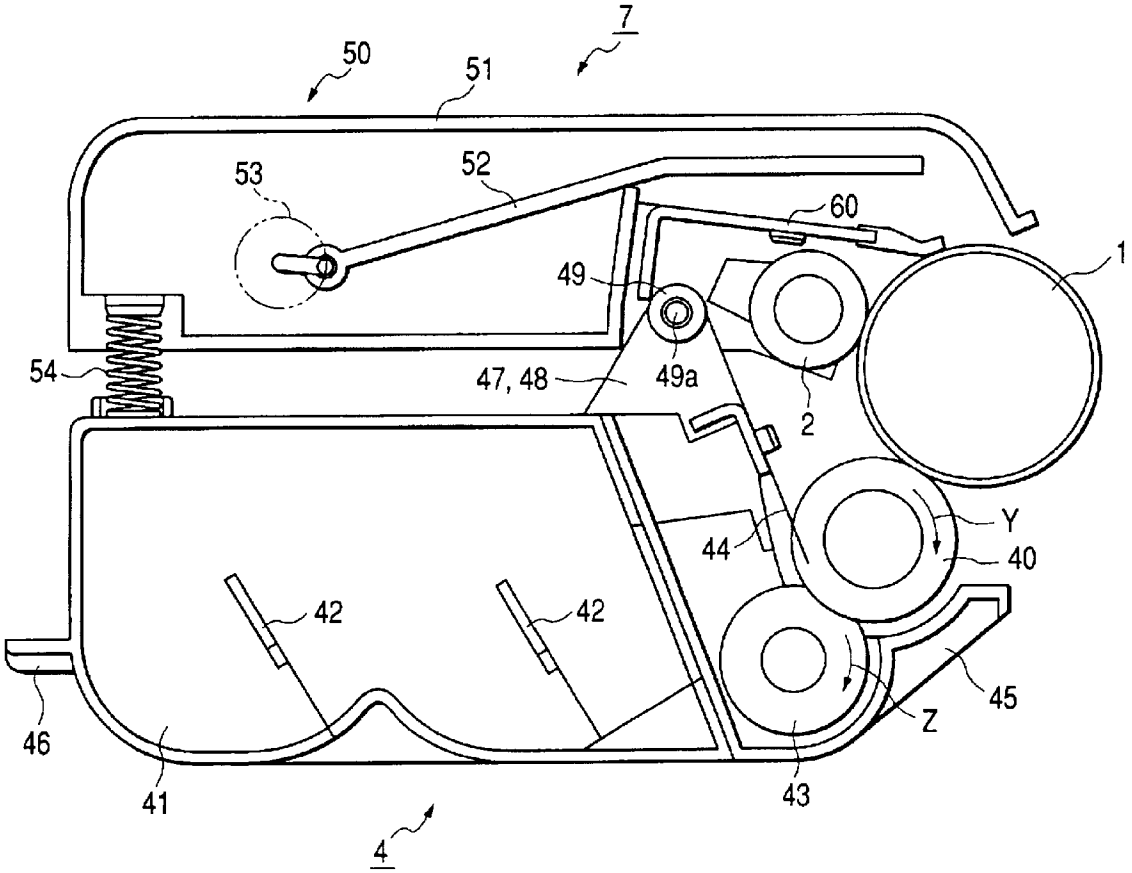
FIG. 2 is a vertical sectional view showing a schematic structure of a process cartridge in accordance with the first embodiment of the present invention.
Figure 3:
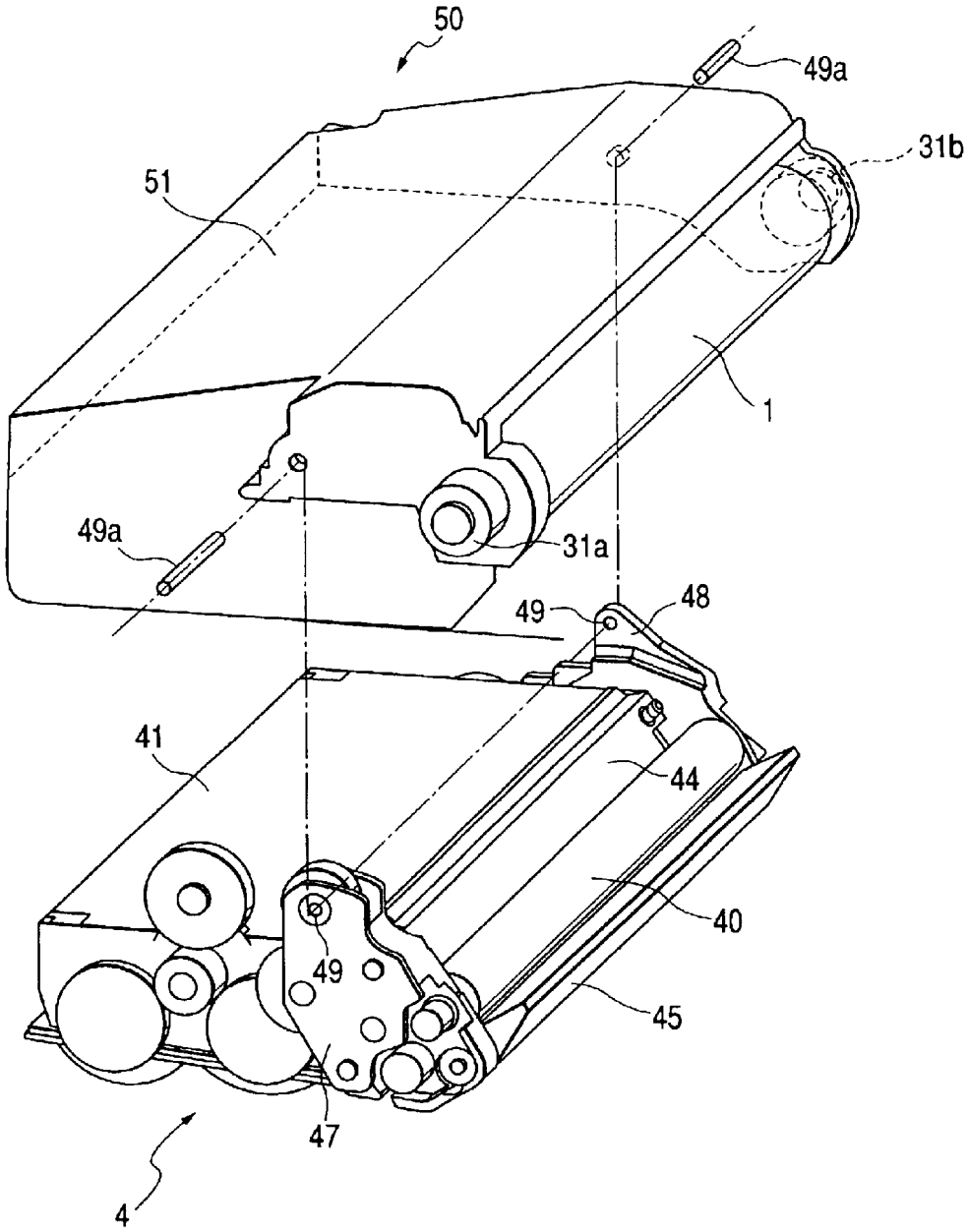
FIG. 3 is a perspective view showing a schematic structure of the process cartridge in accordance with the first embodiment of the present invention.

The process cartridge 7 containing toner in accordance with this embodiment will be described in detail with reference to FIGS. 2 and 3. FIG. 2 is a schematic transverse plane view showing a schematic structure of the process cartridge 7 in accordance with the first embodiment. FIG. 3 is a schematic disassembled perspective view showing a schematic structure of the process cartridge 7 in accordance with the first embodiment.

The process cartridge 7 includes a photosensitive drum 1, a photosensitive drum unit 50 provided with charging means and cleaning means, and a developing unit 4 having developing means for developing an electrostatic latent image on the photosensitive drum 1.

The photosensitive drum 1 is constituted by, for example, an aluminum cylinder having a diameter of 30 mm, applied on its external circumference surface with an organic photoconductive layer (OPC photosensitive body).

As shown in FIG. 3, the photosensitive drum 1 is rotatably attached to a cleaning frame body 51 of the photosensitive drum unit 50 via bearings 31*a* and 31*b*. A charging device 2 for uniformly charging the surface of the photosensitive drum 1 and a cleaning blade 60 for removing transfer residual toner remaining on the photosensitive drum 1 are arranged on the circumference of the photosensitive drum 1. Moreover, the residual toner removed from the surface of the photosensitive drum 1 by the cleaning blade 60 is sequentially sent to a waste toner chamber 53 provided behind the cleaning frame body by a toner conveying mechanism 52. Then, a driving force of a drive motor (not shown) is transmitted to one end in the rear part of the figure, whereby the photosensitive drum 1 is driven to rotate counterclockwise in the figure in response to the image forming operation.

The developing unit 4 is constituted by a developing roller 40 that comes into contact with the photosensitive drum 1 to rotate in an arrow Y direction, a toner container 41 containing toner and a developing frame body 45. The developing roller 40 is rotatably supported by the developing frame body 45 via a bearing member to rotate in an arrow Y direction. In addition, a toner supply roller 43 and a developing blade 44 that come into contact with the developing roller 40 to rotate in an arrow Z direction are arranged on the circumference of the developing roller 40, respectively. Moreover, a toner conveying mechanism 42 for agitating the contained toner and, at the same time, conveying the toner to the toner supply roller 43 is provided in the toner container 41.

In addition, the developing unit 4 has a suspended structure in which the entire developing unit 4 is swingably supported to the photosensitive drum unit 50 around a pin 49*a* inserted through support shaft holes 49 that are provided in bearing members 47 and 48 attached to both the ends of the developing unit 4, respectively. In a state of the process cartridge 7 as a single unit (not inserted in a printer main body), the developing unit 4 is always biased by a pressurizing spring 54 such that the developing roller 40 comes into contact with the photosensitive drum 1 by rotation moment of the developing unit 4 around the pin 49*a*. Moreover, a rib 46, with which parting means 20 (FIG. 1) discussed later of the printer main body A comes into contact when the developing roller 40 is parted from the photosensitive drum 1, is integrally provided in the toner container 41 of the developing unit 4.

Fixing Device

Figure 4:
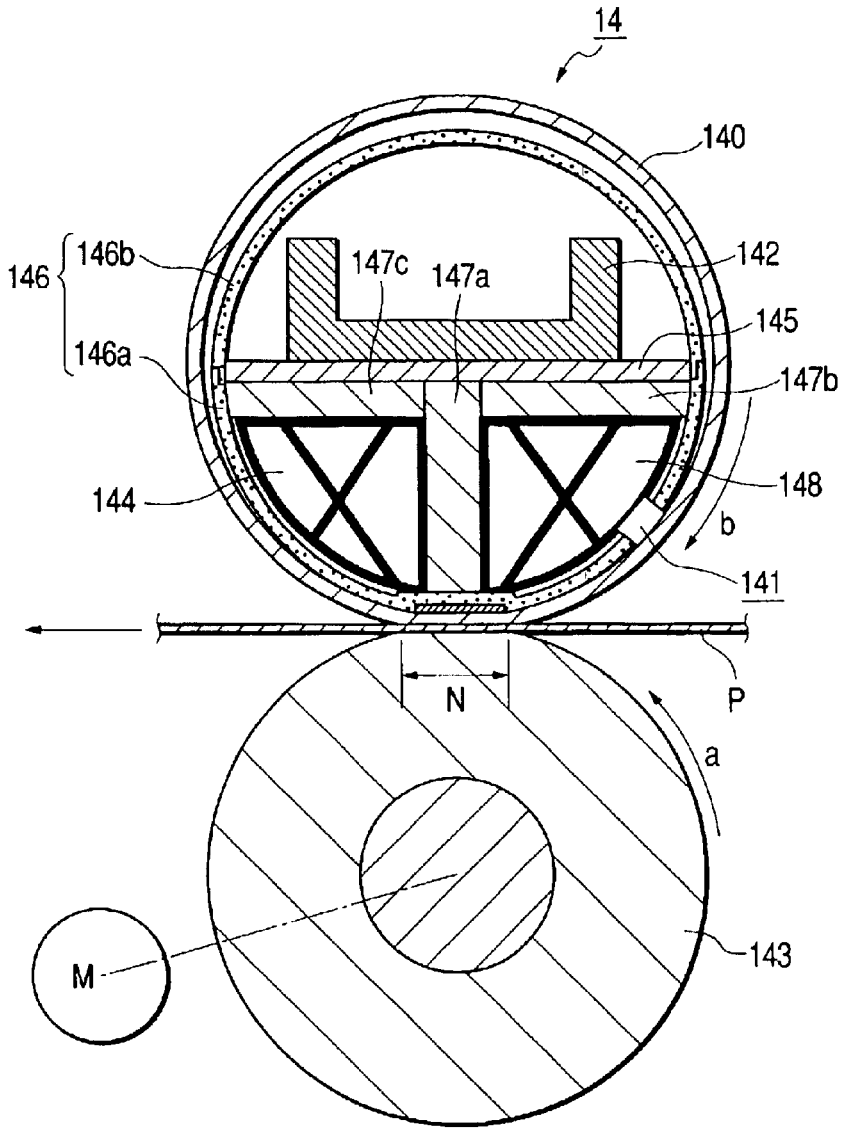
FIG. 4 is a vertical sectional view showing a schematic structure of a fixing device in accordance with the first embodiment of the present invention.

A fixing device in accordance with this embodiment will be described in detail with reference to FIG. 4. FIG. 4 is a vertical sectional view showing a schematic structure of a fixing device of an electromagnetic induction heating system in accordance with the first embodiment.

In the figure, reference numeral 140 denotes a cylindrical fixing film functioning as a rotation body having a heat generating layer (conductive magnetic member). Reference numerals 146*a* and 146*b* denote film supporting members (film guides) of a substantially semicircular gutter shape on their transverse planes in an upper side and a lower side, respectively, and form a substantially cylindrical film guide 146 with opening sides of both of them opposed to each other. The cylindrical fixing film 140 is externally fitted to the outside of this film guide 146 loosely.

An excitation coil 144 and magnetic field generating means consisting of magnetic cores 147*a*, 147*b* and 147*c* combined in a T shape are arranged inside the film guide 146. An excitation circuit (not shown) is connected to the excitation coil 144. Reference numeral 142 denotes a rigid stay for pressurization, which is long in sideways and is arranged in contact with an internal plane portion of the film supporting member 146*b* on the upper side. Reference numeral 145 denotes an insulating member for insulating the magnetic cores 147*a*, 147*b* and 147*c* and the excitation coil 144 from the rigid stay for pressurization 142.

Reference numeral 143 denotes a pressure roller. The fixing film 140 is nipped by the pressure roller 143 and the film guide 146 to apply a predetermined pressurizing force to the film guide 146 from the pressure roller 143, whereby the film guide 146 and the pressure roller 143 form a fixing nip portion N of a predetermined width to be in pressed contact with each other. The magnetic core 147 of the magnetic field generating means 145 is arranged in a position corresponding to a position where the fixing nip portion N is formed.

The pressure roller 143 is driven to rotate counterclockwise by driving means M as indicated by an arrow a. A frictional force is generated between the pressure roller 143 and the external surface of the fixing film 140 by the rotational driving of the pressure roller 143, and a rotation force acts on the fixing film 140. Then, the fixing film 140 rotates around the external circumference of the film guide 146 clockwise as indicated by an arrow b with a peripheral speed substantially corresponding to a peripheral speed of the pressure roller 143 while sliding its inner surface in close contact with the lower surface of the film guide 146 in the fixing nip portion N (pressure roller driving system).

The excitation coil 144 generates an alternating magnetic flux by an alternating current supplied from the excitation circuit (not shown). Since the magnetic core 147*a* of the T shaped magnetic core 147 is provided in a position corresponding to the position of the fixing nip portion N, the alternating magnetic flux is distributed concentratedly in the fixing nip portion N, and the alternating magnetic flux generates an eddy current in the heat generating layer of the fixing film 140. This eddy current generates Joule heat in the heat generating layer by a resistance peculiar to the heat generating layer.

A temperature of the fixing nip portion N is adjusted to maintain a constant temperature by a temperature controlling system (not shown) including a temperature sensor 141 as supply of current to the excitation coil 144 is controlled.

Driving Structure

Next, an operation mechanism in the case of mounting the process cartridge 7 on the printer main body A will be described in detail.

As described before, in a free state of the process cartridge 7 as a single unit, the developing unit 4 is always biased by a pressurizing spring 54 such that the developing roller 40 is always in contact with the photosensitive drum 1 by rotation moment of the developing unit 4 around the pin 49*a* as shown in FIG. 2.

On the other hand, on the inner side of the inserting direction of the process cartridge 7 in the printer main body A, there is arranged a cam 20 (FIG. 1) for parting the developing roller 40 away from the photosensitive drum 1 resisting a biasing force of the developing unit 4. The can 20 is rotated by driving means (not shown). As shown in FIG. 1, the developing roller 40 is parted from the photosensitive drum 1 as the can 20 lifts the rib 46, and the developing roller 40 comes into contact with the photosensitive drum 1 as the cam 20 releases the lifting of the rib 46. Usually, when the process cartridge 7 is inserted in the printer main body A, the cam 20 lifts the rib 46 and the developing roller 40 is parted from the photosensitive drum 1.

Therefore, even if the printer is not used for a long time in a state in which the process cartridge 7 is inserted therein, since the developing roller 40 is always parted from the photosensitive drum 1, permanent deformation of a roller layer, which is caused by contacting the developing roller 40 with the photosensitive drum 1 for a long time, can be surely prevented. The photosensitive drum 1 and the developing roller 40 of the process cartridge 7 inserted in the printer main body A can be driven separately by a motor (not shown).

Image Forming Operation

Figure 5:
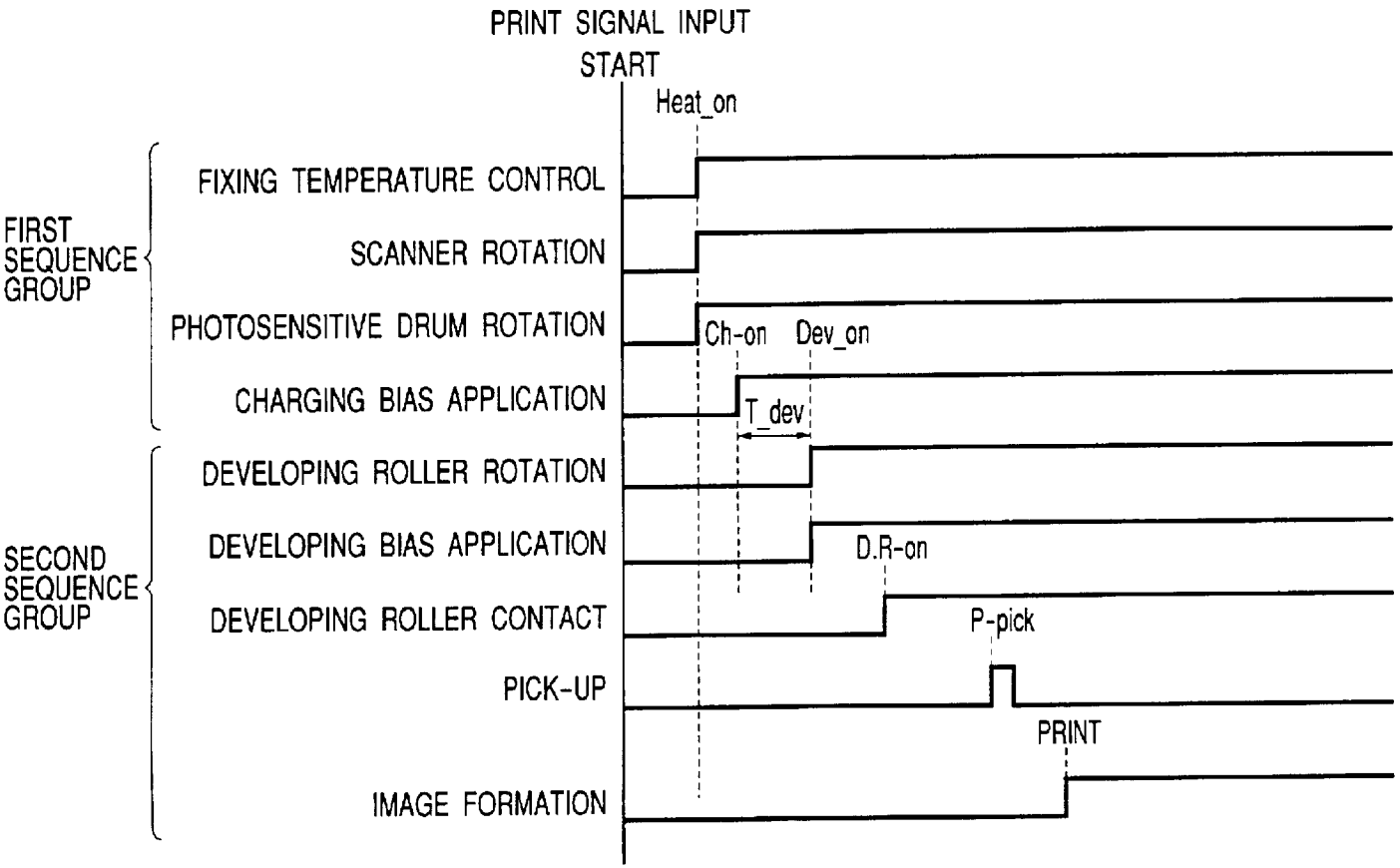
FIG. 5 is a timing chart representing operations of the image forming apparatus in accordance with the first embodiment of the present invention.
Figure 6:
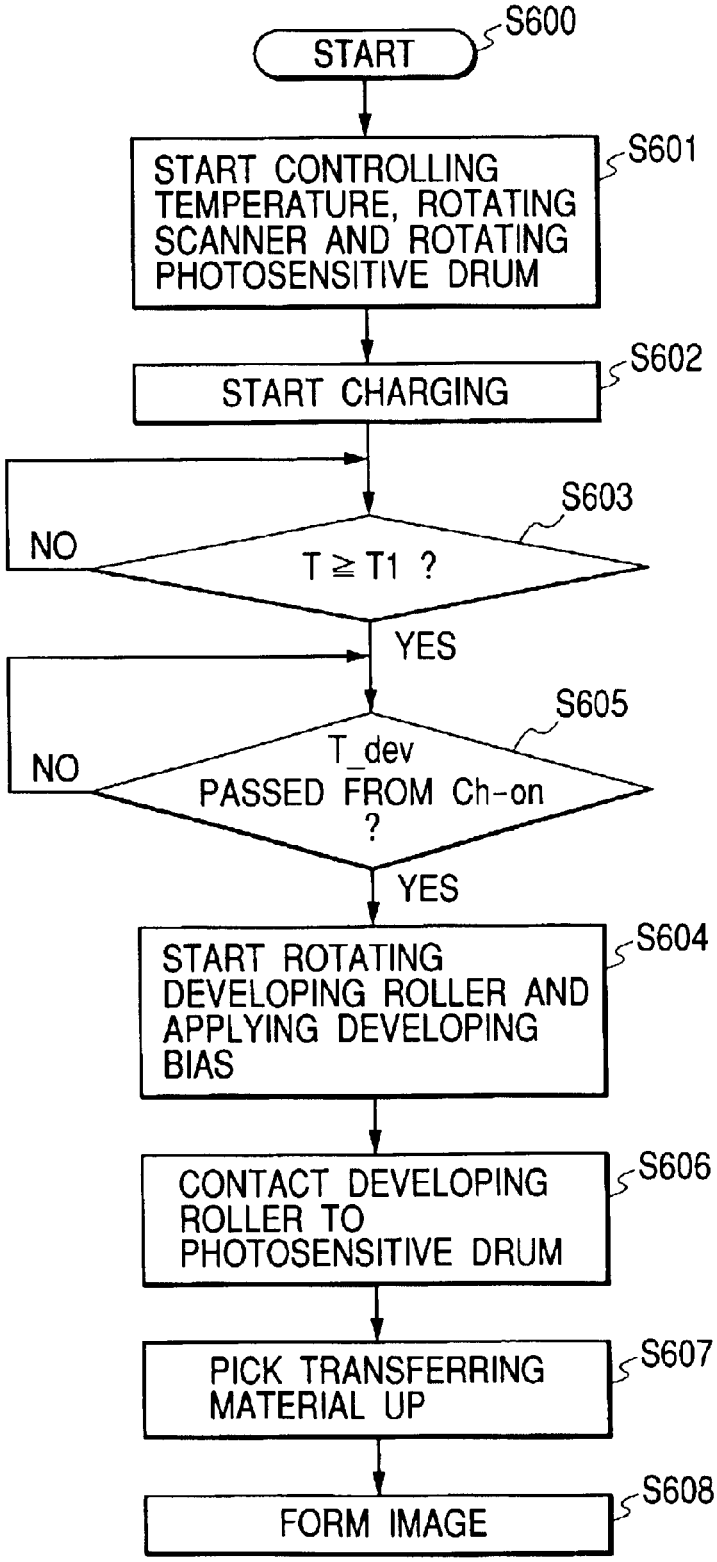
FIG. 6 is a flow chart representing operations of the image forming apparatus in accordance with the first embodiment of the present invention.

An image forming operation in accordance with this embodiment will be described in detail with reference to FIGS. 1, 5 and 6. FIG. 5 is a timing chart representing operation sequences of the image forming apparatus in accordance with the first embodiment. FIG. 6 is a flow chart representing operations of the image forming apparatus in accordance with the first embodiment. When the operation of the image forming apparatus is started by the input of a print signal in an image forming apparatus main body (Start, S600), first, the CPU 17 starts fixing temperature control for controlling the fixing device 14 to a predetermined temperature, rotation of the photosensitive drum 1 and rotation of the scanner unit 3 as a first sequence group (Heat-on, S601). In this embodiment, the above-mentioned three sequences are collectively referred to as the first sequence group. At this point, the developing roller 40 is still stopped.

Next, the CPU 17 starts applying a charging bias at a predetermined time after the photosensitive drum 1 starts rotation (Ch-on, S602). This is because a memory is likely to occur on the photosensitive drum 1 if the rotation of the photosensitive drum 1 and the application of the charging bias are simultaneously performed. This application of the charging bias is also included in the first sequence group.

Next, the CPU 17 judges if the temperature T of the fixing device 14 has reached a predetermined temperature T1 (S603). This predetermined temperature T1 is a temperature at which it is expected that a temperature of the fixing device 14 can reach a temperature sufficient for fixing of the transferring material P when the transferring material P reaches the fixing device 14 if the temperature control is continued without change even when the image forming apparatus is under a low temperature environment or when a supplied power supply voltage is at a lower limit value.

If the temperature T of the fixing device 14 has reached T1, the CPU 17 starts rotating the developing roller 40 and applying a developing bias after a predetermined time T_dev from the start of application of the charging bias (Ch-on) (Dev-on, S604). At this point, if the temperature T of the fixing device 14 has not reached T1, the CPU 17 continues to monitor a temperature of the fixing device 14 or, if the temperature of the fixing device 14 has reached T1 within T_dev, the CPU 17 waits for the temperature T to reach T_dev (S605) to start rotating the developing roller 40 and applying a developing bias. In this embodiment, control of the application of a developing bias, the rotation of the developing roller, and the like corresponds to the second sequence group. Timing of operations of the second sequence group is determined depending on whether or not a detected temperature of the fixing device has reached the temperature T1 as described above.

If the temperature T has reached T1 after T-dev, the CPU 17 starts rotating the developing roller 40 and applying a developing bias at a point when the temperature T has reached T1. Usually, a sufficient parting distance is secured between the photosensitive drum 1 and the developing roller 40. If the developing roller 40 is parted, toner does not scatter to the photosensitive drum 1 from the developing roller 40 even if the surface of the photosensitive drum 1 is not properly charged.

However, in order to prevent toner from scattering even if the parting distance is reduced due to some cause, the CPU 17 starts rotating the developing roller 40 and applying a developing bias after the time T_dev when the photosensitive drum 1 is charged to a regular potential. Therefore, even if the temperature T of the fixing device has already reached T1 within T_dev, the CPU 17 does not perform the rotation of the developing roller 40 and the application of a developing bias until the time T_dev is reached. The image forming apparatus that starts rotating the developing roller 40 and applying a developing bias at the time T_dev attains a shortest print time.

After Dev-on, the CPU 17 causes the developing roller 40 to be in contact with the photosensitive drum 1 after a predetermined time with Dev-on as a reference (D_R-on, S606), and then picks a transferring material up (P-pick, S607) to form an image (Print, S608).

In a case in which a temperature rising state of the fixing device 14 is judged after picking the transferring material up, if the CPU 17 determines that a temperature of the fixing device 14 is insufficient and stops the image forming operation once to perform only temperature rising of the fixing device 14, it is likely that decrease of printing accuracy is caused. Therefore, judgment of a temperature rising state should be performed before picking the transferring material up.

However, if a temperature rising state of the transfer material is judged immediately before staring picking the transferring material up, the rotations of the photosensitive drum 1 and the developing roller 40 have already started. If temperature rising of the fixing device is insufficient and the pick-up operation is held in standby until the fixing device reaches a predetermined temperature, the photosensitive drum 1 and the developing roller 40 continue to rotate during that period. Since a usable life of a developing device is significantly affected by the number of rotation of a developing roller, it is desirable to control a rotation time of the developing roller to a necessary minimum.

On the other hand, since a surface potential of the photosensitive drum 1 charged once does not attenuate unless a transfer bias is applied to it or it is exposed, electric discharge for charging does not successively suffer the photosensitive drum if it is simply applied a charging bias to rotate. Therefore, it is not likely that the surface of the photosensitive drum 1 is scraped by discharge and its useful life is reduced.

Thus, as in this embodiment, the CPU 17 detects the temperature T of the fixing device 14 by the temperature sensor 141 and judges if the temperature T has reached T1 in S603 to control timing for the second sequence group to start operations, that is, timing for starting rotating developing roller 40 and applying a developing bias in this embodiment, depending on a result of the judgement. Then, it is possible to surely increase temperature of the fixing device without reducing a usable life of a developing device even if the image forming apparatus is under a low temperature environment or if a supplied power supply voltage falls to a lower limit value.

Further, the second sequence group is not limited to the above-mentioned operations but may be a sequence group including an operation for determining timing of an image forming operation such as pick-up of a transferring material, or the like, from a detected temperature of a fixing device at a predetermined time after input of a print signal such that the fixing device is warmed up to a predetermined temperature when the transferring material reaches the fixing device.

Therefore, as described above, image formation and temperature rising of a fixing device are performed in parallel and, if the temperature rising of the fixing device is not in time for the image formation, an image forming operation such as rotation of a developing roller belonging to the second sequence group is performed after the fixing device reaches a predetermined temperature. Thus, it becomes possible to reduce unnecessary image forming operations of a developing device or the like and to extend a usable life of the developing device or a photosensitive drum without extending FPOT.

Second Embodiment

Figure 7:
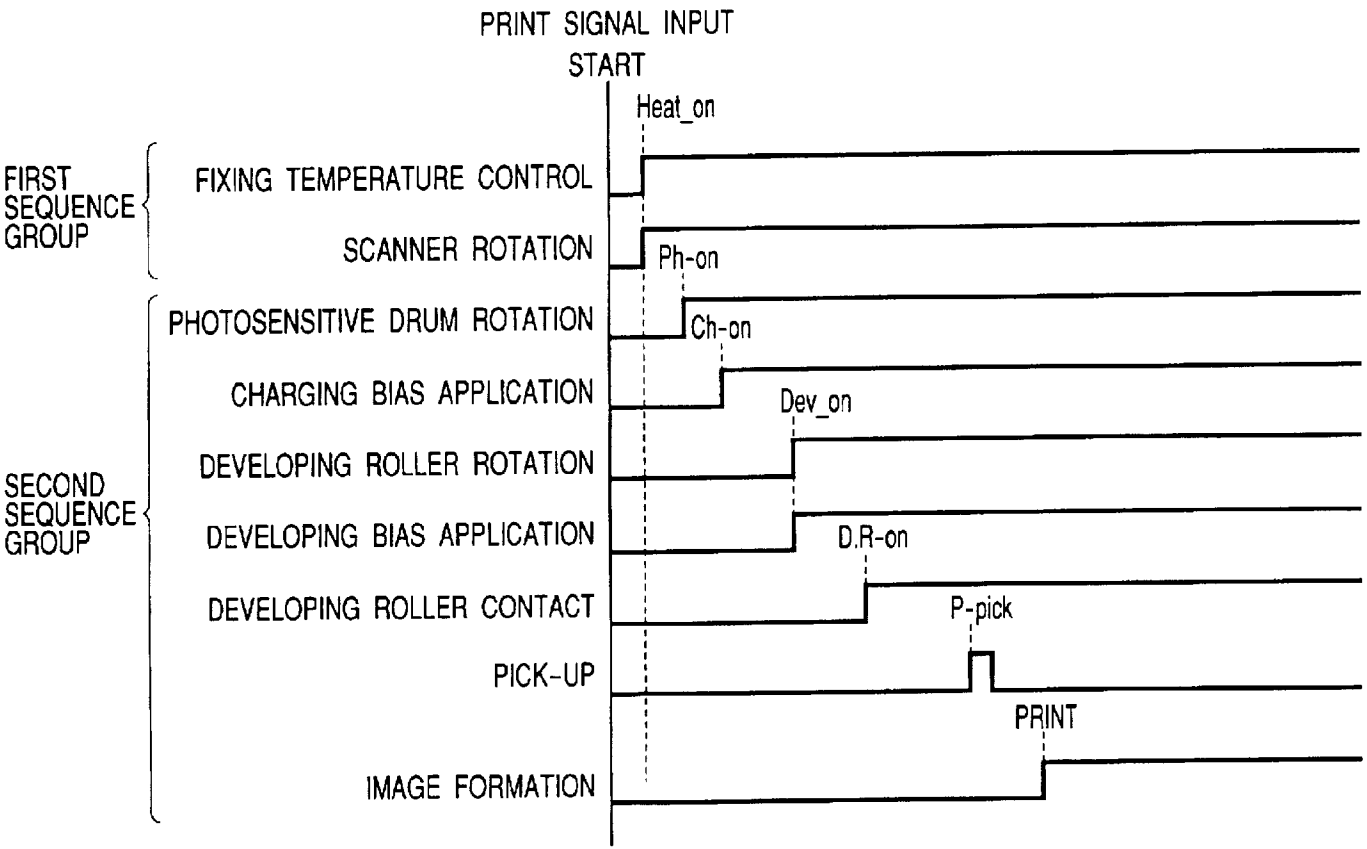
FIG. 7 is a timing chart representing operations of an image forming apparatus in accordance with a second embodiment of the present invention.
Figure 8:
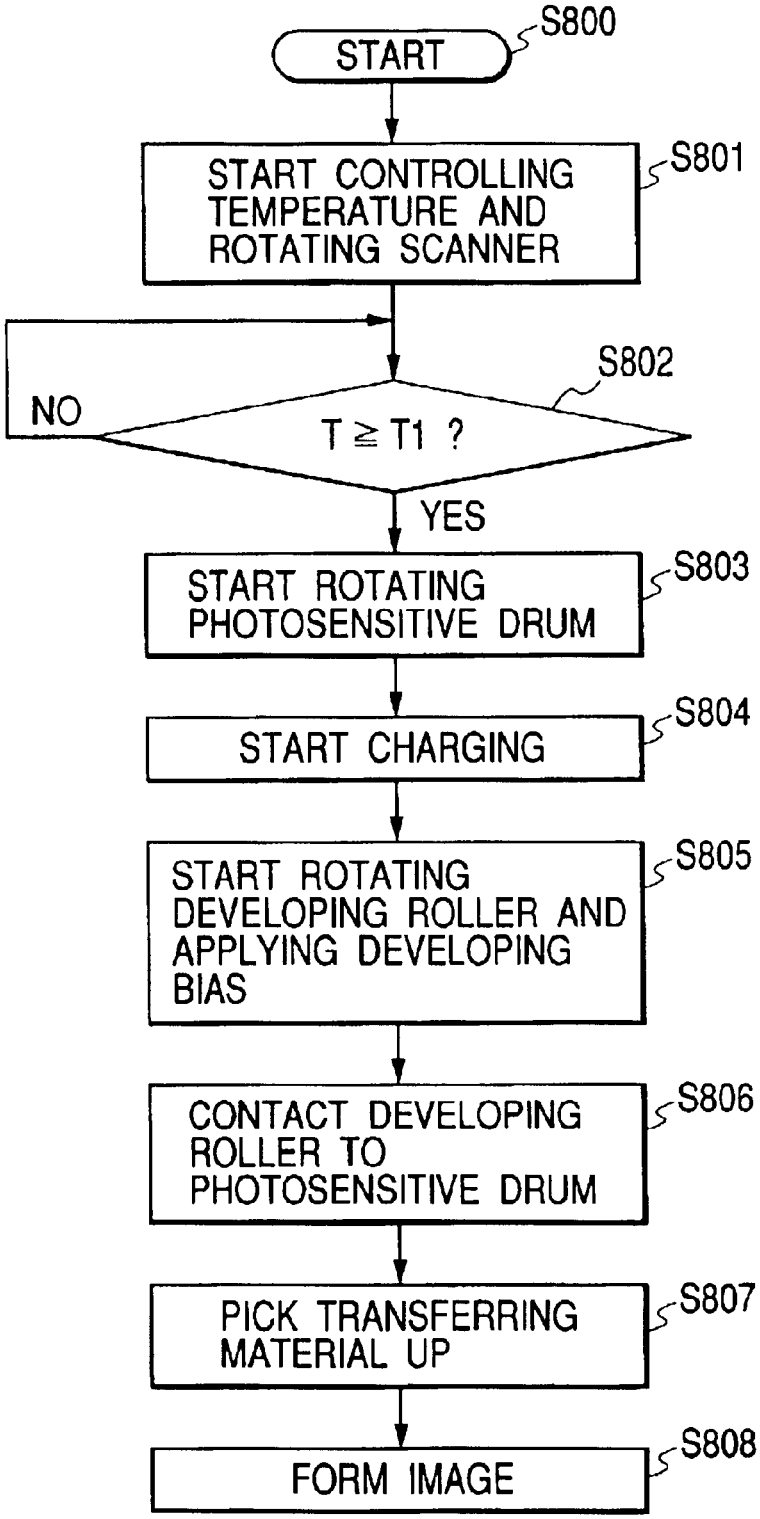
FIG. 8 is a flow chart representing operations of the image forming apparatus in accordance with the second embodiment of the present invention.

Image forming operations in accordance with a second embodiment of the present invention will be described in detail with reference to FIGS. 1, 7 and 8. FIG. 7 is a timing chart representing operations of an image forming apparatus in accordance with the second embodiment. FIG. 8 is a flow chart representing operations of the image forming apparatus in accordance with the second embodiment. Note that parts having the same structure and actions as those in the first embodiment are denoted by the identical reference numerals, and the parts will not be described.

When operations of the image forming apparatus is started by input of a print signal in an image forming apparatus main body (Start, S800), first, the CPU 17 starts controlling fixing temperature for controlling the fixing device 14 to a predetermined temperature and rotation of the scanner 3 as a first sequence group (Heat-on, S801). In this embodiment, rotation of a photosensitive drum and application of a charging bias are not included in the first sequence group.

Next, the CPU 17 judges if the temperature T of the fixing device 14 has reached the predetermined temperature T1 (S802). This predetermined temperature T1 is a temperature at which it is expected that a temperature of the fixing device 14 can reach a temperature sufficient for fixing of the transferring material P when the transferring material P reaches the fixing device 14 if the temperature control is continued without change even when the image forming apparatus is under a low temperature environment or when a supplied power supply voltage is at a lower limit value. The CPU 17 continues heating until the temperature T of the fixing device 14 reaches TI and, when the temperature T has reached T1, the CPU 17 starts rotating a photosensitive drum (Ph-on, S803), applying a charging bias (Ch-on, S804), rotating the developing roller 40 and applying a developing bias (Dev-on, S805), contacting a developing roller to the photosensitive drum (D_R-on, S806), picking up a transferring material (P-pick, S807) and forming an image (Print, S808) with a predetermined interval. In this embodiment, control of the rotation of the photosensitive drum 1, the application of a charging bias, the application of a developing bias, the rotation of the developing roller 40, and the like corresponds to the second sequence group. Timing of operations of the second sequence group is determined depending on whether a detected temperature of the fixing device 14 has reached the predetermined temperature T1 as described above.

In the first embodiment, the photosensitive drum 1 continues to rotate while a temperature of the fixing device 14 is rising to the predetermined temperature T1. In the first embodiment, since electric discharge for charging does not successively occur if the photosensitive drum 1 is simply rotated, the photosensitive drum 1 is not scraped by electric discharge. However, since the cleaning blade 60 actually comes into contact with the photosensitive drum 1, the photosensitive drum 1 may be slightly scraped. In particular, if an efficiency of transferring a toner image on the photosensitive drum 1 to a transferring material at the time of image formation is extremely good, an amount of toner scraped by the cleaning blade 60 as transfer residual toner on the photosensitive drum 1 is reduced. As a result, since an amount of toner acting as lubricant between the photosensitive drum 1 and the cleaning blade 60 decreases, frictional resistance of the cleaning blade 60 increases and the photosensitive drum 1 tends to be scraped.

Thus, as in this embodiment, the CPU 17 detects the temperature T of the fixing device 14 by the temperature sensor 141 and judges if the temperature T has reached T1 in S802 to control timing for the second sequence group to start operations, that is, timing for respective image forming sequences after the start of rotating photosensitive drum 1 and applying a developing bias in this embodiment, depending on a result of the judgement. Then, it is possible to surely increase temperature of the fixing device without reducing a usable life of photosensitive drum and developing device even if the image forming apparatus is under a low temperature environment or if a supplied power supply voltage falls to a lower limit value.

Third Embodiment

Image forming operations in accordance with a third embodiment of the present invention will be hereinafter described. This embodiment is characterized in that a fixing device is preheated when operations of the image forming apparatus is stopped (at the time of standby) in the image forming apparatus of the first embodiment. Since the quick start fixing device of the electromagnetic induction heating system as in the first embodiment has a small thermal capacity of a heating member unlike the conventional fixing device of the heat roller system, it can be preheated with a slight electric power. Thus, in this embodiment, the fixing device is preheated to about 120° C. at the time of standby and usual heating is performed simultaneously with starting the image forming operations.

In this way, since the fixing device has already been heated to 120° C., temperature rising to a fixing temperature is quicker than rising temperature from a room temperature and timing for starting rotating a developing roller and applying a developing bias is hardly delayed, whereby stable FPOT can be maintained. In addition, even if the image forming apparatus is placed under an extremely low temperature environment or a power supply voltage drops to a lower limit value, a time for the rotation of a developing roller and the application of a developing bias can be minimized.

However, dispersion occurs in a temperature control time after starting printing in such a preheating state. Therefore, FPOT can be further reduced by using the present invention described in the first and second embodiments at the time of print operations following preheating in the same manner.

Fourth Embodiment

A fourth embodiment of the present invention will be hereinafter described. This embodiment is a color image forming apparatus to which the first embodiment is applied. Note that parts having the same structure and actions as those in the first embodiment are denoted by the identical reference numerals, and the parts will not be described.

Overall Structure

Figure 9:
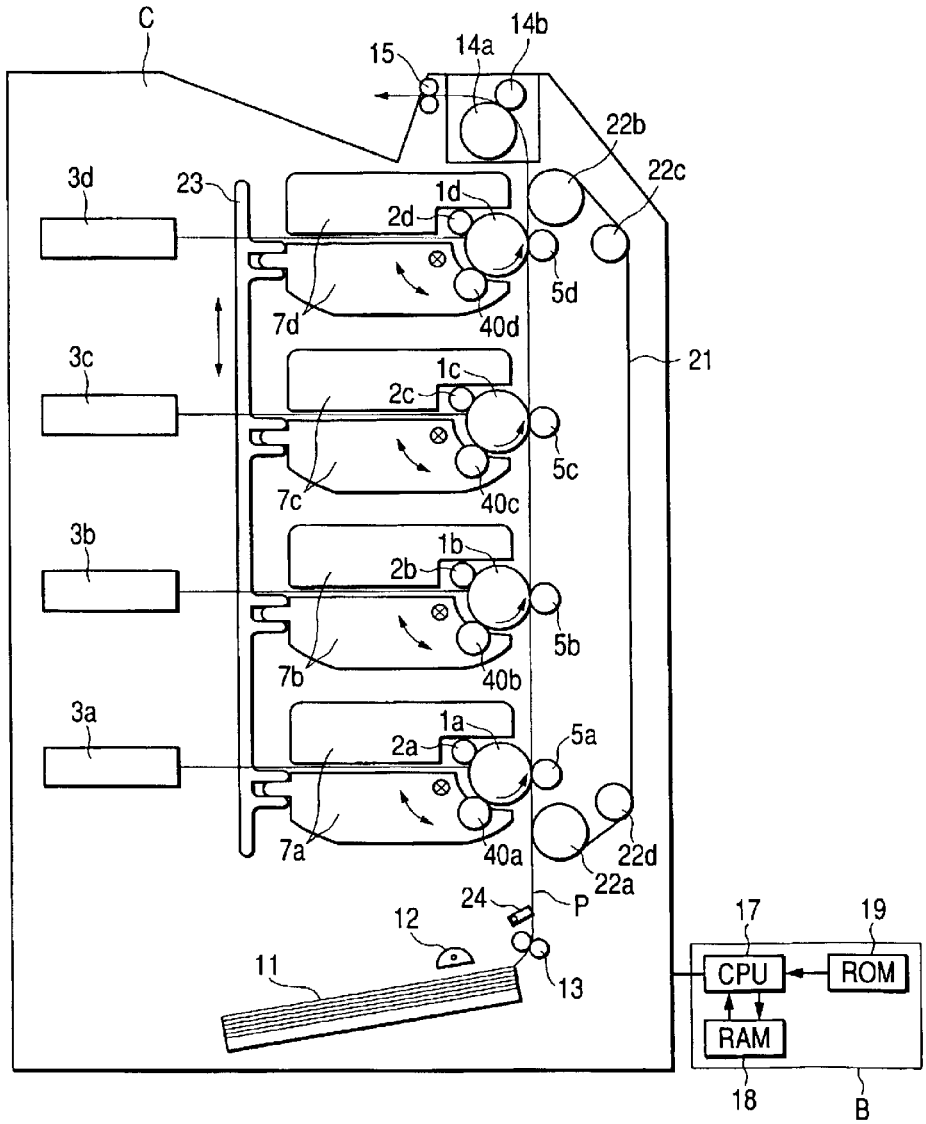
FIG. 9 is a vertical sectional view showing a schematic structure of an image forming apparatus in accordance with a fourth embodiment of the present invention.

An image forming apparatus in accordance with this embodiment will be described in detail with reference to FIG. 9. FIG. 9 is a vertical sectional view showing an overall structure of a full color laser beam printer C that is a form of a color image forming apparatus in accordance with the fourth embodiment.

The color image forming apparatus C shown in the figure has a structure in which process cartridges 7 (7*a*, 7*b*, 7*c* and 7*d*) which contain color toners of yellow, magenta, cyan and black, respectively, are vertically stacked. Each of the process cartridges 7 is the same as the process cartridge described in the first embodiment.

Scanner units 3 (3*a*, 3*b*, 3*c* and 3*d*) are vertically stacked in the same manner as the process cartridges 7 (7*a*, 7*b*, 7*c* and 7*d*) and are arranged in a substantially horizontal direction from photosensitive drums 1 (1*a*, 1*b*, 1*c* and 1*d*).

Next, an electrostatic transferring belt 21 is arranged, which is opposed to all the photosensitive drums 1*a*, 1*b*, 1*c* and 1*d* and circulates to move so as to come into contact with them. As the electrostatic transfer belt 21, a resin material of PVdF (a rubber material of polyvinylidene fluoride), polyamide, polyimide, PET (polyethylene terephthalate) with a thickness of approximately 50 to 300 μm and a volume resistance of approximately $10^9$ to $10^{16}$ Ω·cm or polycarbonate or a rubber material such as chloroprene rubber, EPDM, NBR, urethane rubber or the like with a thickness of approximately 0.5 to 2 mm and a volume resistance of approximately $10^9$ to $10^{16}$ Ω·cm is used. In addition, the volume resistance may be adjusted to approximately $10^7$ to $10^{11}$ Ω·cm by dispersing a conductive filler such as carbon, ZnO, $SnO_2$ or $TiO_2$ in the above-mentioned materials if necessary.

This electrostatic transferring belt 21 is supported by four shafts of rollers 22*a*, 22*b*, 22*c* and 22*d* in the vertical direction and circulates to move so as to electrostatically attract the transferring material P to its external circumference surface on the left side in the figure and cause the transferring material P to come into contact with the photosensitive drums 1 (1*a*, 1*b*, 1*c* and 1*d*). Consequently, the transferring material P is conveyed to a transferring position by the electrostatic transferring belt 21, and each toner image on the photosensitive drums 1 (1*a*, 1*b*, 1*c* and 1*d*) is transferred thereto, respectively.

Transferring rollers 5 (5*a*, 5*b*, 5*c* and 5*d*) are arranged in a line in positions where they are in contact with the inside of the electrostatic transferring belt 21 and are opposed to the four photosensitive drums 1 (1*a*, 1*b*, 1*c* and 1*d*), respectively.

The transferring rollers 5 (5*a*, 5*b*, 5*c* and 5*d*) are for electrostatically transferring toner images formed on the photosensitive drums 1 (1*a*, 1*b*, 1*c* and 1*d*) to the transferring material P on the transferring belt 21. As the transferring rollers 5 (5*a*, 5*b*, 5*c* and 5*d*), for example, a core bar of metal covered by an elastic body such as ethylene-propylene-diene ternary copolymer (EPDM), urethane rubber or nitrile butadiene rubber (NBR) adjusted to have a volume resistance of approximately $10^5$ to $10^8$ Ω·cm can be used. A bias of a positive polarity is applied to these transfer rollers 5 (5*a*, 5*b*, 5*c* and 5*d*) from a power supply (not shown), and toner images of a negative polarity on the photosensitive drums 1 (1*a*, 1*b*, 1*c* and 1*d*) are transferred to the transferring material P, which is in contact with the photosensitive drum 1, by an electric field created by this bias.

Driving Structure

Next, an operational mechanism at the time when the process cartridges 7 are inserted in the printer main body C will be described in detail.

In the first embodiment, there is provided the cam for causing the developing roller 40 to part from the photosensitive drum 1 resisting a biasing force of the developing unit 4 on the inner side in the inserting direction of the process cartridge. In this second embodiment, a parting plate 23 is arranged such that parting and contact of developing rollers of four colors can be performed simultaneously. This parting plate 23 can be moved up and down by a driving motor (not shown). Then, when the parting plate 23 moves up, the developing rollers 40 (40*a*, 40*b*, 40*c* and 40*d*) are parted from the photosensitive drums 1 (1*a*, 1*b*, 1*c* and 1*d*). When the parting plate 23 moves down, the developing rollers 40 (40*a*, 40*b*, 40*c* and 40*d*) come into contact with the photosensitive drums 1 (1*a*, 1*b*, 1*c* and 1*d*).

Usually, when the developing rollers 40 (40*a*, 40*b*, 40*c* and 40*d*) are brought into contact with the photosensitive drums 1 (1*a*, 1*b*, 1*c* and 1*d*), the photosensitive drums 1 (1*a*, 1*b*, 1*c* and 1*d*) vibrate by impact of the contact. Therefore, it is preferable to contact the developing rollers 40 (40*a*, 40*b*, 40*c* and 40*d*) to the photosensitive drums 1 (1*a*, 1*b*, 1*c* and 1*d*) simultaneously for four colors as in this embodiment rather than in turn for four colors and to cause the occurrence of impact of contact only once because influence to an image can be controlled.

In inserting the process cartridges 7 (7*a*, 7*b*, 7*c* and 7*d*) in the printer main body C, the parting plate 23 is pushed up and the ribs 46 provided in the developing unit 4 move onto protruded parts of the parting plate 23 following the insertion of the process cartridges 7 (7*a*, 7*b*, 7*c* and 7*d*) to bring the developing rollers 40 (40*a*, 40*b*, 40*c* and 40*d*) to be parted from the photosensitive drums 1 by a predetermined space. This parted state is always maintained when the power supply is off and when development is not performed.

Therefore, even if the printer is not used for a long time in a state in which the process cartridge 7 is inserted therein, since the developing roller 40 is always parted from the photosensitive drum 1, permanent deformation of a roller layer, which is caused by contacting the developing roller 40 with the photosensitive drum 1 for a long time, can be surely prevented. The photosensitive drum 1 and the developing roller 40 of the process cartridge 7 inserted in the image forming apparatus main body C can be driven separately by a motor (not shown).

Image Forming Operation

Next, an image forming operation of this embodiment will be described with reference to a schematic sectional view of FIG. 9, a timing chart of FIG. 10 and a flow chart of FIG. 11.

When the operation of the image forming apparatus is started by the input of a print signal in an image forming apparatus main body (Start, S1100), first, the CPU 17 starts fixing temperature control for controlling the fixing device 14 to a predetermined temperature, rotation of the photosensitive drums 1 (1*a*, 1*b*, 1*c* and 1*d*) and rotation of the electrostatic transferring belt 21 as a first sequence group (Heat-on, S1101). Next, after a predetermined time, the CPU 17 starts rotating the scanner units 3 (3*a*, 3*b*, 3*c* and 3*d*) (Scan-on, S1102). Here, start-up timing is staggered because, if four motors for driving the photosensitive drums 1 (1*a*, 1*b*, 1*c* and 1*d*), one motor for driving the electrostatic transferring belt 21 and four scanner motors are simultaneously started up, it is likely that a capacity of the power supply is exceeded. At this point, the developing rollers 40 (40*a*, 40*b*, 40*c* and 40*d*) remain stopped.

Next, the CPU 17 starts applying a charging bias at a predetermined time after the photosensitive drums 1 (1*a*, 1*b*, 1*c* and 1*d*) start rotation for prevention of a memory (Ch-on, S1103). Then, the CPU 17 judges if the temperature T of the fixing device 14 has reached the predetermined temperature T1 (S1104). This predetermined temperature T1 is a temperature at which it is expected that a temperature of the fixing device 14 can reach a temperature sufficient for fixing of the transferring material P when the transferring material P reaches the fixing device 14 if the temperature control is continued without change even when the image forming apparatus is under a low temperature environment or when a supplied power supply voltage is at a lower limit value.

If the temperature T of the fixing device 14 has reached T1, rotation of the developing rollers 40 (40*a*, 40*b*, 40*c* and 40*d*) and application of a developing bias are started after a predetermined time T dev from the start of the application of a charging bias (Ch-on) (Dev-on, S1105).

At this point, if the temperature T of the fixing device 14 has not reached T1, the CPU 17 continues to monitor a temperature of the fixing device 14 or, if the temperature of the fixing device 14 has reached T1 within T_dev, the CPU 17 waits for the temperature T to reach T_dev (S1106) to start rotating the developing rollers 40(40*a*, 40*b*, 40*c* and 40*d*) and applying a developing bias. If the temperature T of the fixing device 14 has reached T1 after T_dev, the CPU 17 starts rotating the developing rollers 40 (40*a*, 40*b*, 40*c* and 40*d*) and applying a developing bias at the point when the temperature T has reached T1. After Dev-on, the CPU 17 causes the developing rollers 40 (40*a*, 40*b*, 40*c* and 40*d*) to come into contact with the photosensitive drums 1 (1*a*, 1*b*, 1*c* and 1*d*) after a predetermined time with Dev-on as a reference (D_R-on, S1107), and then picks a transferring material up (P-pick, S1108) to form an image (Print, S1109).

Thus, as in this embodiment, the CPU 17 detects the temperature T of the fixing device 14 by the temperature sensor 141 and judges if the temperature T has reached T1 in S1104 to control timing for the second sequence group to start operations, that is, timing for starting rotating the developing rollers 40 (40*a*, 40*b*, 40*c* and 40*d*) and applying a developing bias in this embodiment, depending on a result of the judgement. Then, it is possible to surely increase temperature of the fixing device without reducing a usable life of a developing device even if the image forming apparatus is under a low temperature environment or if a supplied power supply voltage falls to a lower limit value.

Fifth Embodiment

Figure 12:
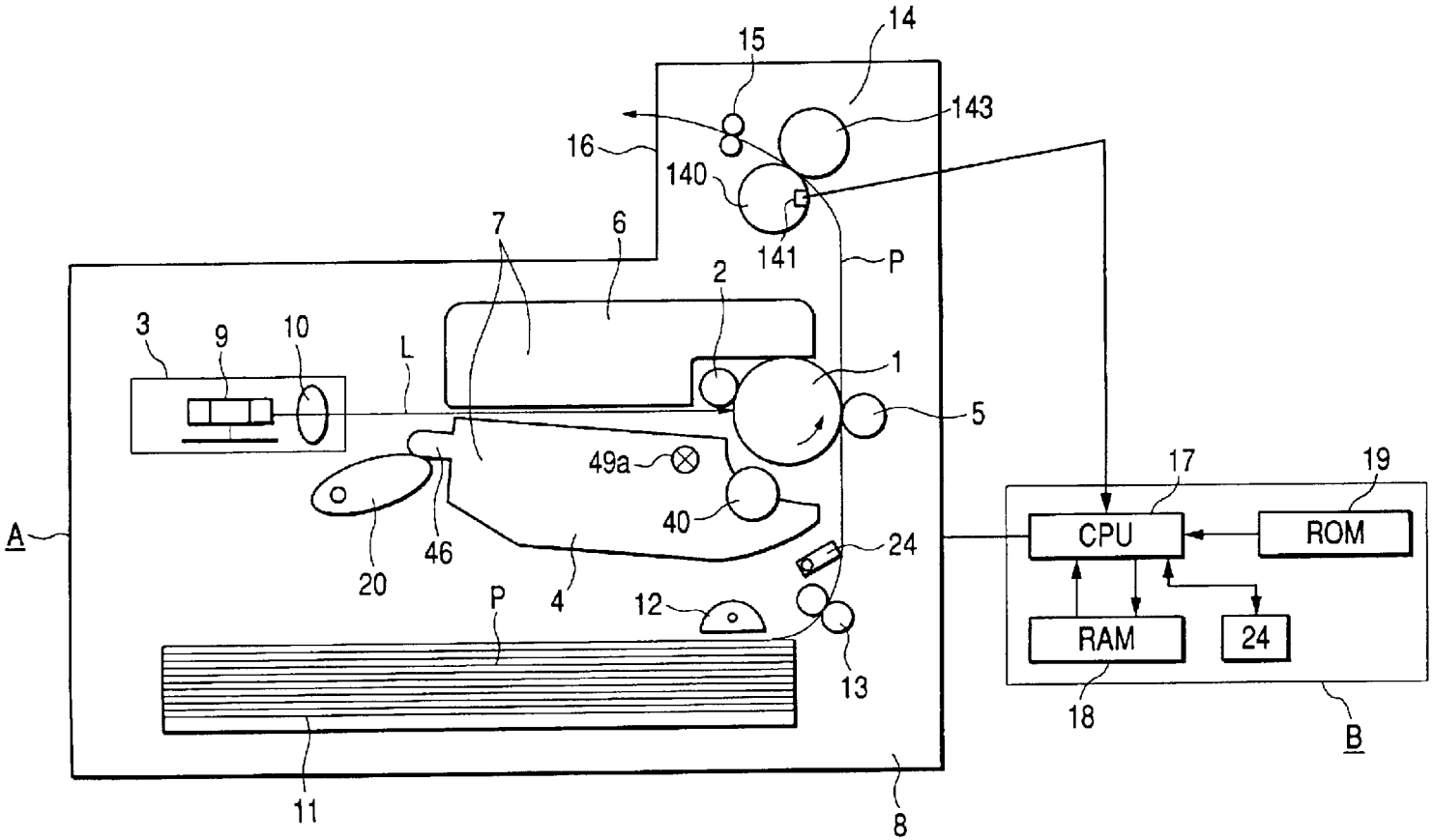
FIG. 12 is a sectional view showing a schematic structure of an image forming apparatus in accordance with a fifth embodiment of the present invention.

FIG. 12 is a vertical sectional view showing an overall structure of the laser beam printer A in a fifth embodiment of the present invention. Points different from the aforementioned first embodiment (FIG. 1) will be hereinafter described.

The control device B for controlling operations of the image forming apparatus A has a timer 24*a* controllable by the CPU 17 in addition to the CPU 17, the RAM (random access memory) 18 and the ROM (read only memory) 19. The other points are the same as those in the structure shown in FIG. 1.

Image Forming Operation

Figure 13:
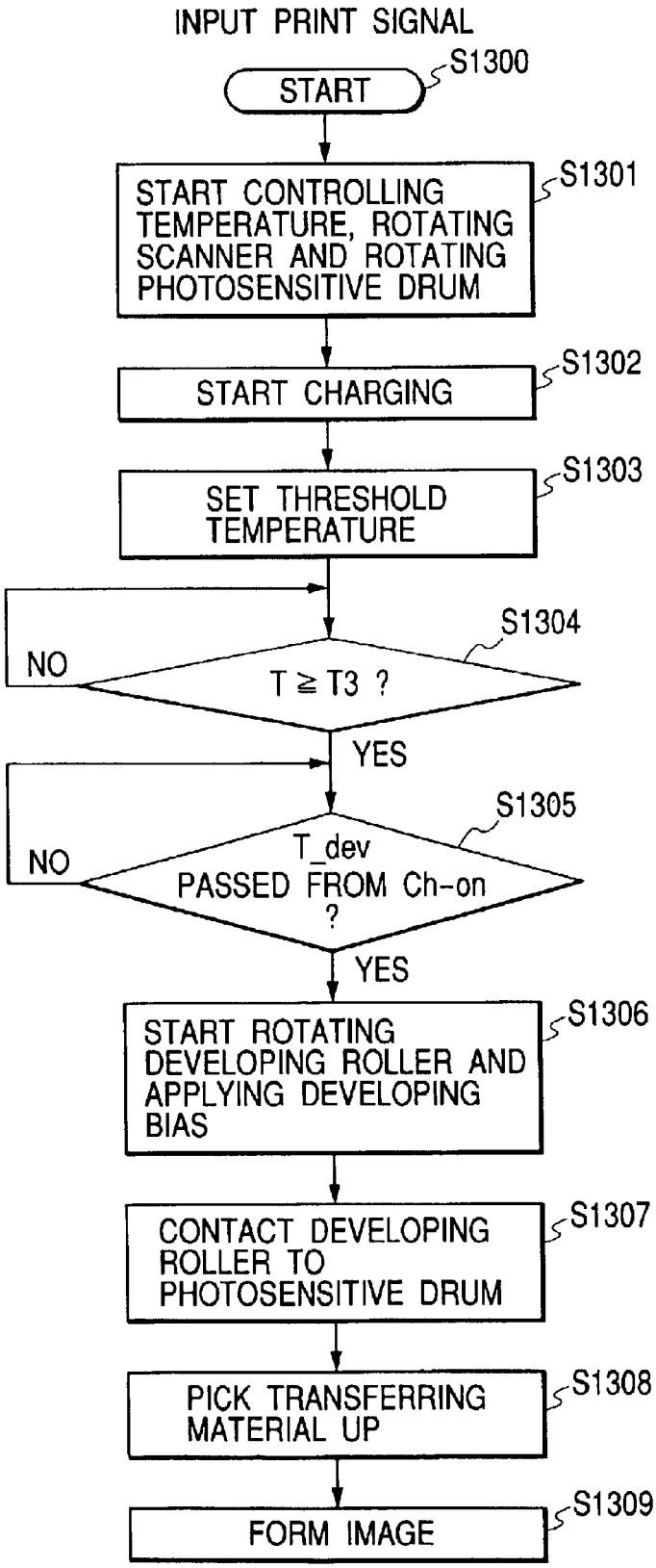
FIG. 13 is a flow chart representing operations of the image forming apparatus in accordance with the fifth embodiment of the present invention.

An image forming operation in accordance with this embodiment will be described in detail with reference to FIGS. 12, 5 and 13. An operation sequence of an image forming apparatus in accordance with the fifth embodiment is the same as the timing chart shown in FIG. 5. FIG. 13 is a flow chart representing operations of the image forming apparatus in accordance with the fifth embodiment.

When a print signal is inputted in an image forming apparatus main body, the operation of the image forming apparatus is started (Start, S1300). First, the CPU 17 starts fixing temperature control for controlling the fixing device 14 to a predetermined temperature, rotation of the photosensitive drum 1 and rotation of the scanner unit 3 as a first sequence group (Heat-on, S1301). In this embodiment, the above-mentioned three sequences are collectively referred to as a first sequence group.

Heating of the fixing device 14 is started simultaneously with the input of a print signal in the image forming apparatus main body or after the input of a print signal.

On the other hand, control of application of a developing bias, rotation of a developing roller, and the like corresponds to a second sequence group in this embodiment.

Next, the CPU 17 starts applying a charging bias at a predetermined time after the photosensitive drum 1 starts rotation (Ch-on, S1302). This is because it is likely that a memory occurs on the photosensitive drum 1 if the rotation of the photosensitive drum 1 and the application of a charging bias are simultaneously performed. This application of a charging bias is also included in the first sequence group.

Simultaneously with the start of the first sequence group, the CPU 17 starts monitoring a temperature of the fixing device 14 and sets a threshold temperature T3 for starting up the second sequence group (S1303). This setting method will be described later.

After setting the threshold temperature T3, the CPU 17 continues to monitor the temperature of the fixing device 14. When the temperature T has reached T3, the CPU 17 judges if T_dev has passed from Ch-on (S1302) when the temperature T has reached T3 (S1305). The CPU 17 starts rotating the developing roller 40 and applying a developing bias after waiting for T_dev to pass if T_dev has not passed from Ch-on when the temperature T has reached T3 or, immediately starts rotating the developing roller 40 and applying a developing bias if T_dev has already passed from Ch-on when the temperature T has reached T3 (Dev-on, S1306).

Usually, a sufficient parting distance is secured between the photosensitive drum 1 and the developing roller 40. If the developing roller 40 is parted, toner does not scatter to the photosensitive drum 1 from the developing roller 40 even if the surface of the photosensitive drum 1 is not properly charged. However, in order to prevent toner from scattering even if the parting distance is reduced due to some cause, the CPU 17 starts rotating the developing roller 40 and applying a developing bias after the time T_dev when the photosensitive drum 1 is charged to have a regular potential. Therefore, even if the temperature T of the fixing device has already reached T3 within T_dev, the CPU 17 does not perform the rotation of the developing roller 40 and the application of a developing bias until the time T_dev is reached. The image forming operation that starts rotating the developing roller 40 and applying a developing bias at the time T_dev attains a shortest print time.

After Dev-on, the CPU 17 causes the developing roller 40 to come into contact with the photosensitive drum 1 after a predetermined time with Dev-on as a reference (D_R-on, S1307), and then picks a transferring material up (P-pick, S1308) to form an image (Print, S1309).

Method of Setting a Threshold Temperature

Figure 14:
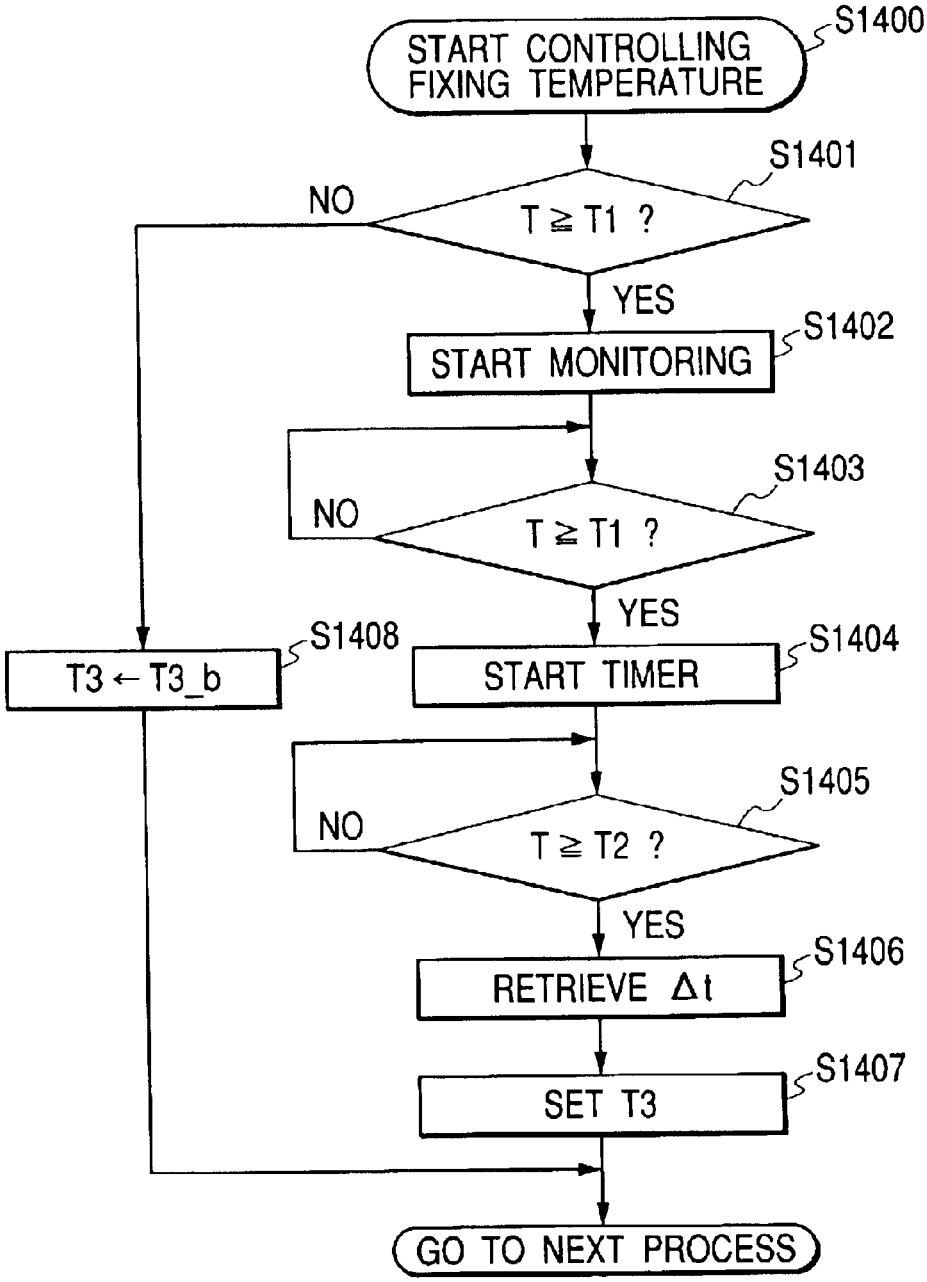
FIG. 14 is a flow chart representing a method of determining a threshold temperature of the image forming apparatus in accordance with the fifth embodiment of the present invention.

A method of setting the threshold temperature T3 in this embodiment will be described with reference to a flow chart of FIG. 14 and temperature rising curves of FIG. 15.

First, when the first sequence is started up and energization of the fixing device 14 begins (S1400), the CPU 17 starts monitoring a temperature of the fixing device 14 (S1402). Then, when the temperature has reached the predetermined temperature T1 (S1403), the CPU 17 starts up the timer 24 (S1404). The CPU 17 continues to monitor the temperature and, when the temperature has reached the predetermined temperature T2 (S1405), the CPU 17 stops the timer 24 to retrieve time At when the temperature has reached T2 from T1 (S1406). That is, a temperature rising curve of the fixing device 14 can be judged from this At. It can be seen that, if Δt is small, the temperature rising curve is steep and temperature rises fast and, if Δt is large, the temperature rising curve is gentle and temperature rises slowly. Next, the CPU 17 determines the threshold temperature T3 for deciding timing for starting the second sequence group based on a value of this Δt (S1407).

Figure 15:
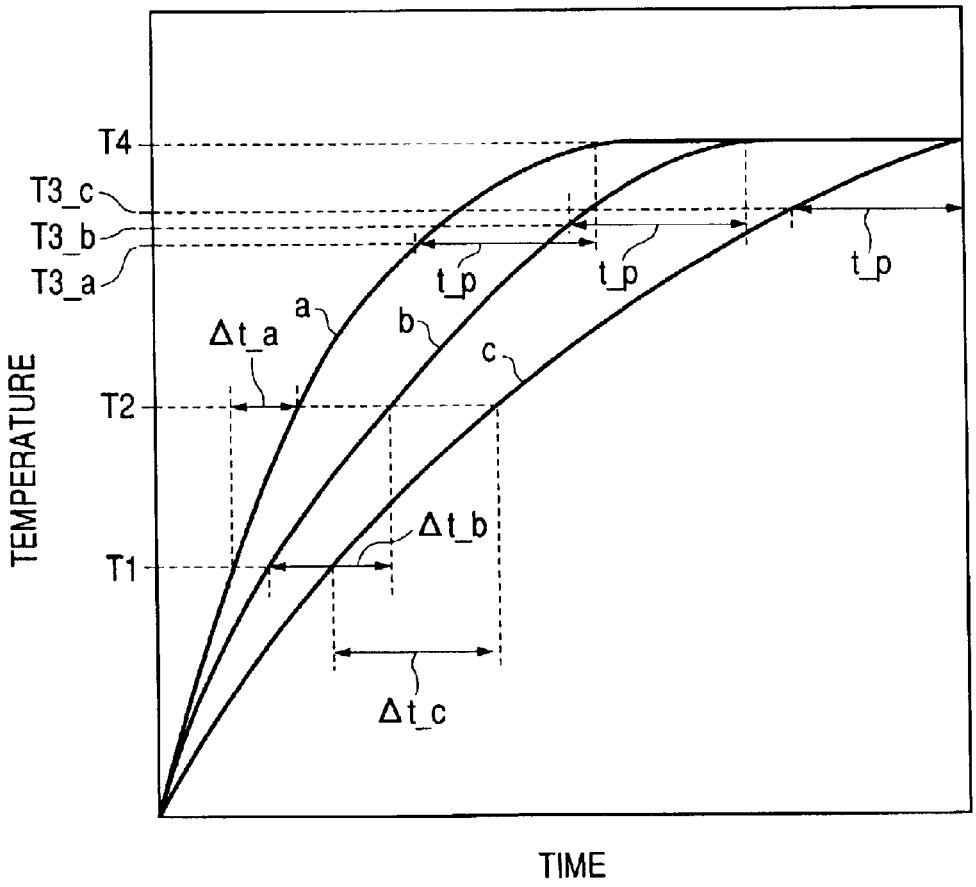
FIG. 15 is a graph showing temperature rising curves of the image forming apparatus in accordance with the fifth embodiment of the present invention.

FIG. 15 shows a difference of a temperature rising curve according to a difference of environment and an input voltage. In the figure, "a" indicates a temperature rising curve under a highest temperature in which the image forming apparatus is assumed to be placed and when a power supply voltage is an upper limit value, "b" indicates a temperature rising curve when a temperature and a power supply voltage are normal, and "c" is a temperature rising curve under a lowest temperature in which the image forming apparatus is placed and when a power supply voltage is a lower limit value. In each temperature rising curve, a time for the temperature of the fixing device 14 to reach T2 from T1 is Δt_a, Δt_b and Δt_c, respectively. In addition, T4 is a temperature necessary for fixing a transferring material, and t_p is a predetermined time from a time when the second sequence group is started until a time when a transferring material reaches the fixing device 14. Therefore, as a threshold temperature for starting the second sequence group, temperatures T3_a, T3_b and T3_c, which are temperatures at a time that is set back from T4 by the predetermined time t_p in the temperature rising curves a, b and c, may be regarded as values of T3, respectively.

Since a threshold temperature is determined for each temperature rising curve, the threshold temperature T3 corresponding to Δt is set based on these values. That is, T3 is set as shown in Table 1 below.

TABLE 1

| | T3 set value |
|---|---|
| $\Delta t < (\Delta t_a + \Delta t_b)/2$ | T3_a |
| $(\Delta t_a + \Delta t_b)/2 \leqq \Delta t \leqq (\Delta t_b + \Delta t_c)/2$ | T3_b |
| $(\Delta t_b + \Delta t_c)/2 < \Delta t$ | T3_c |

The threshold temperature T3 may be found more precisely using relationships between Δt and, Δt_a and T3_a, Δt_b and T3_b and Δt_c and T3_c by using a proportional calculation.

T1 and T2 at which temperature rising curves are found are selected from a temperature section where the temperature rising curves extend linearly and represent characteristics of the temperature rising curves. In this embodiment, 40° C. and 80° C. are preferable as T1 and T2, respectively.

Further, if the fixing device 14 has already been warmed up by immediately preceding image formation, a temperature of the fixing device 14 may have already exceeded T1 and T2 at a point when monitoring of the temperature of the fixing device 14 is started (S701). Since it is confirmed that the temperature of the fixing device 14 can surely rise at such a point, T3_b is set as T3 unconditionally in this embodiment (S708). However, when the temperature of the fixing device 14 is between T1 and T2, Δt may be found by the following expression using a temperature T0 when monitoring was started and a time Δt' when the temperature reached T2 to set T3 based on this Δt.

$$\Delta t=(T2-T1)/(T2-T0)\times\Delta t'$$

Thus, as in this embodiment, the CPU 17 monitors a temperature of the fixing device 14 to find a temperature rising curve of the fixing device 14 and set the threshold temperature T3 for starting up the second sequence group based on the temperature rising curve, and then judges if the temperature of the fixing device 14 has reached T3 to control timing for the second sequence group to start operations, that is, timing for starting rotating the developing roller 40 and applying a developing bias in this embodiment, depending on a result of the judgement. Then, it is possible to accurately match timing of completion of temperature rising of the fixing device 14 and timing of reaching of the transferring material P to the fixing device 14 even if the image forming apparatus is placed under any situation. Therefore, FPOT can be always made shortest in a situation in which the image forming apparatus is placed and unnecessary rotation of a developing device can be controlled. Moreover, since it is also possible to control an unnecessary heating time of the fixing device 14, the present invention is also effective for energy saving.

Sixth Embodiment

Figure 16:
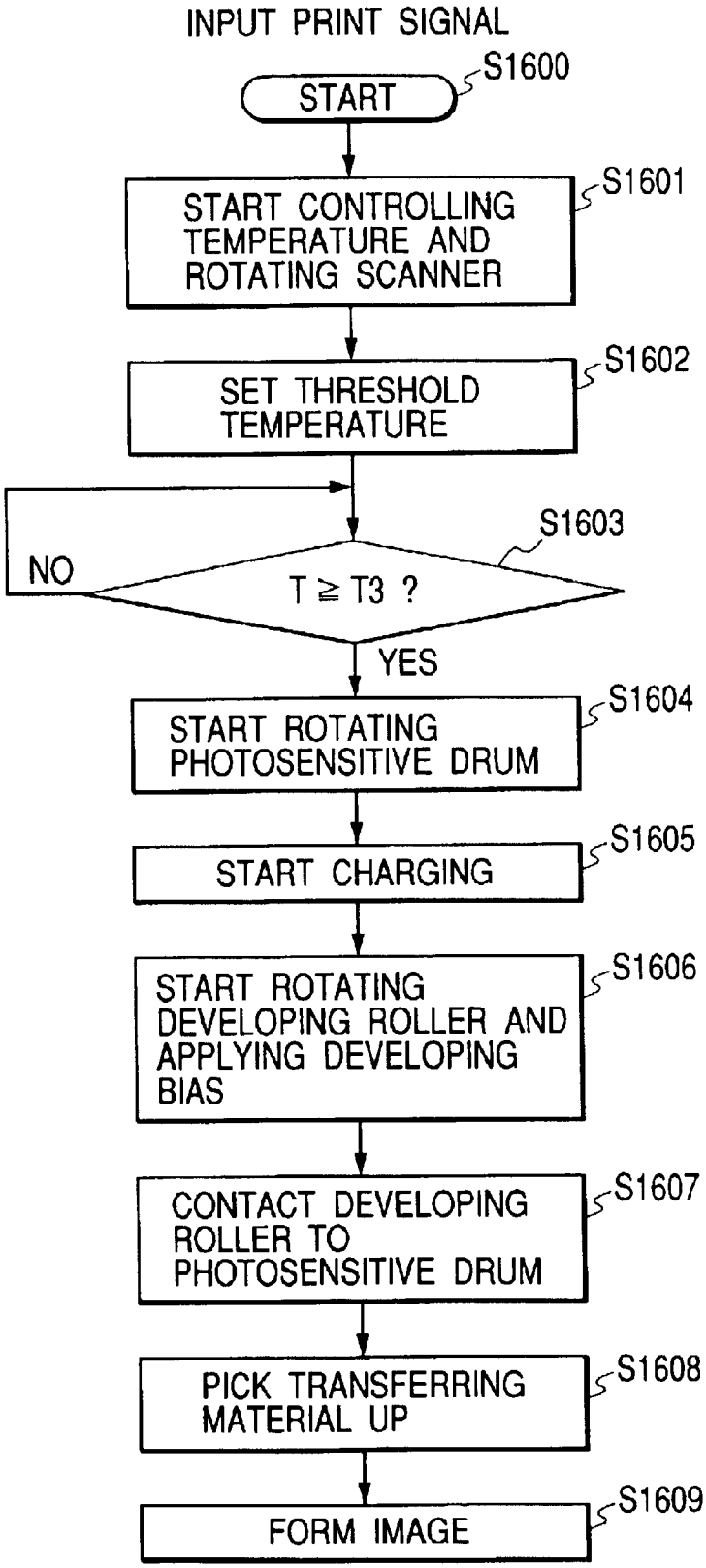
FIG. 16 is a flow chart representing operations of an image forming apparatus in accordance with a sixth embodiment of the present invention.

An image forming operation in accordance with a sixth embodiment of the present invention will be described in detail with reference to FIGS. 12, 7 and 16. An operation timing chart of an image forming apparatus of the sixth embodiment is the same as that of the image forming apparatus in accordance with the second embodiment (FIG. 7). FIG. 16 is a flow chart representing operations of the image forming apparatus in accordance with the sixth embodiment.

When the operation of the image forming apparatus is started by the input of a print signal in an image forming apparatus main body (Start, S1600), first, the CPU 17 starts fixing temperature control for controlling the fixing device 14 to a predetermined temperature and rotation of the scanner unit 3 as a first sequence group (Heat-on, S1601). In this embodiment, unlike the first embodiment, rotation of a photosensitive drum and application of a charging bias are not included in the first sequence group.

Next, the CPU 17 sets the threshold temperature T3 for starting up a second sequence group with the same method as the fifth embodiment (S1602), and then judges if the temperature T of the fixing device 14 has reached the threshold temperature T3 (S1603). The CPU 17 continues the judgement until the temperature T of the fixing device 14 reaches T3 and, when the temperature T has reached T3, the CPU 17 starts rotating a photosensitive drum (Ph-on, S1604), applying a charging bias (Ch-on, S1605), rotating the developing roller 40 and applying a developing bias (Dev-on, S1606), contacting a developing roller to the photosensitive drum (D_R-on, S1607), picking up of a transferring material (P-pick, S1608) and forming an image (Print, S1609) with a predetermined interval. In this embodiment, control of the rotation of a photosensitive drum, the application of a charging bias, the application of a developing bias, the rotation of a developing roller, and the like corresponds to the second sequence group. Timing of operations of the second sequence group is determined depending on whether or not a temperature of the fixing device has reached the threshold temperature T3 as described above.

In the fifth embodiment, the photosensitive drum 1 continues to rotate while waiting for temperature of the fixing device to rise. In the fifth embodiment, since electric discharge for charging does not successively occur if the photosensitive drum 1 is simply rotated, the photosensitive drum is not scraped by electric discharge. However, since the cleaning blade 60 actually comes into contact with the photosensitive drum 1, the photosensitive drum may be slightly scraped. In particular, if an efficiency of transferring a toner image on the photosensitive drum 1 to a transferring material at the time of image formation is extremely good, an amount of toner scraped by the cleaning blade 60 as transfer residual toner on the photosensitive drum 1 is reduced. As a result, since an amount of toner acting as lubricant between the photosensitive drum 1 and the cleaning blade 60 decreases, frictional resistance of the cleaning blade 60 increases and the photosensitive drum 1 tends to be scraped.

Thus, as in this embodiment, by monitoring a temperature of the fixing device 14 and judging if the temperature T has reached T3 in S1103, to control timing for the second sequence group to start operations, that is, timing of each image forming sequence after starting rotating the photosensitive drum 1 in this embodiment is controlled by a result of the judgement. Then, it is possible to accurately match timing of completion of temperature rising of the fixing device 14 and timing of reaching of the transferring material P to the fixing device 14 even if the image forming apparatus is placed under any situation. Therefore, FPOT can be always made shortest in a situation in which the image forming apparatus is placed and unnecessary rotation of the photosensitive drum 1 or a developing device can be controlled. Moreover, since it is also possible to control an unnecessary heating time of the fixing device 14, the present invention is also effective for energy saving.

Seventh Embodiment

Figure 17:
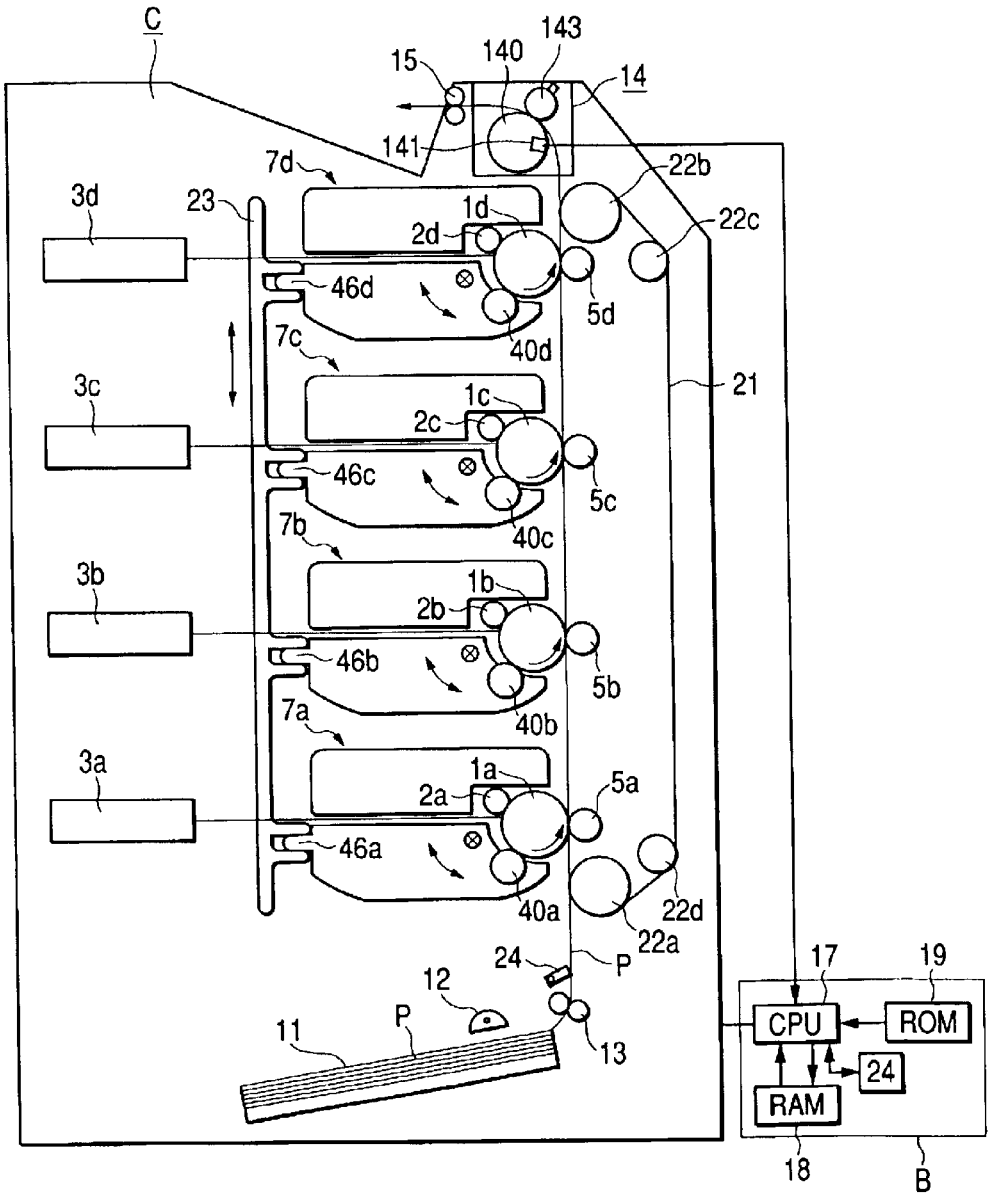
FIG. 17 is a vertical sectional view showing a schematic structure of an image forming apparatus in accordance with a seventh embodiment of the present invention.

A seventh embodiment of the present invention will be hereinafter described. This embodiment is a color image forming apparatus to which the fifth embodiment is applied. FIG. 17 is a vertical sectional view showing an overall structure of the full color laser beam printer C that is a form of a color image forming apparatus in accordance with the seventh embodiment. Note that parts having the same structure and actions as those in the fourth embodiment are denoted by the identical reference numerals, and the parts will not be described.

Image Forming Operation

Figure 10:
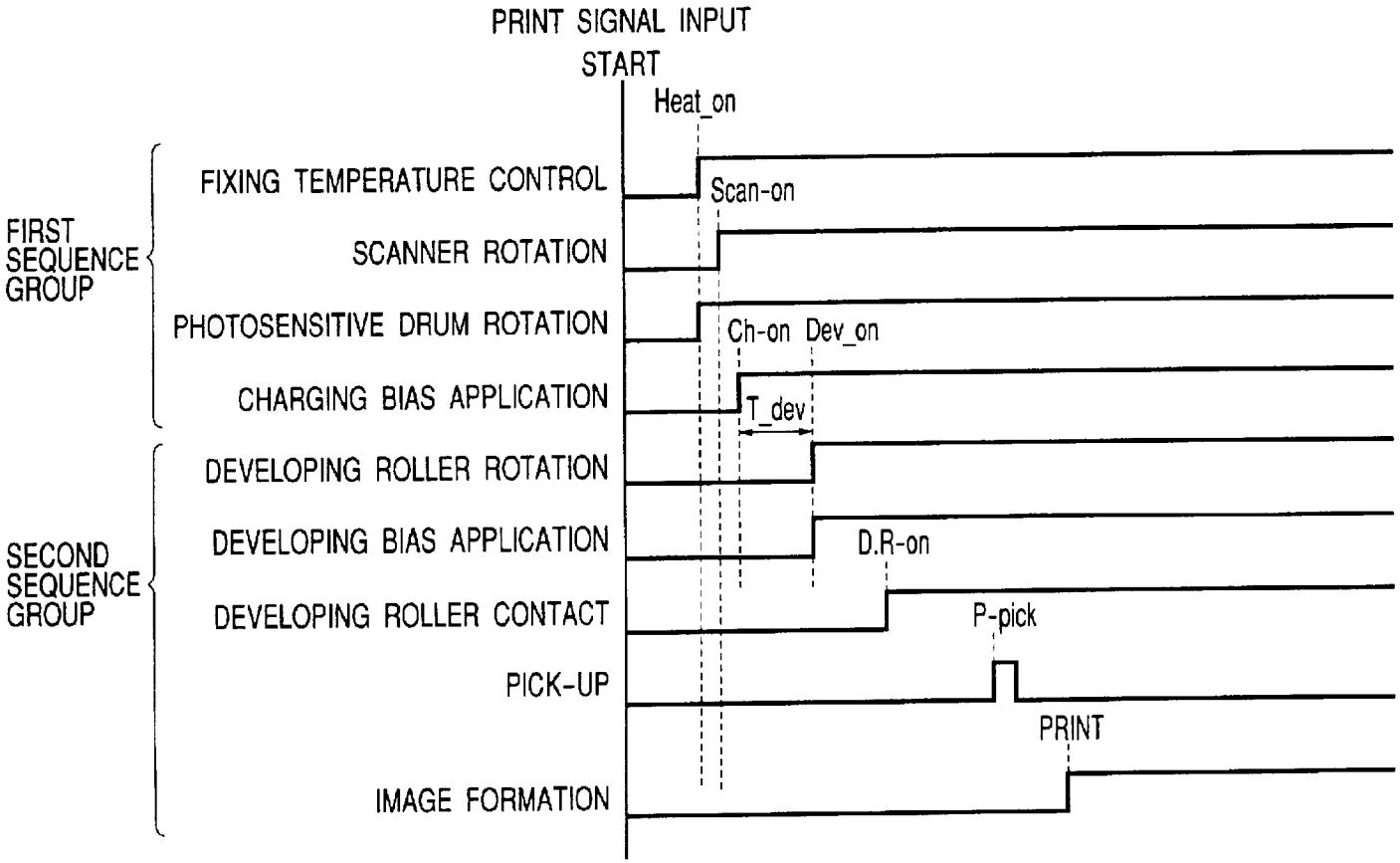
FIG. 10 is a timing chart representing operations of the image forming apparatus in accordance with the fourth embodiment of the present invention.
Figure 11:
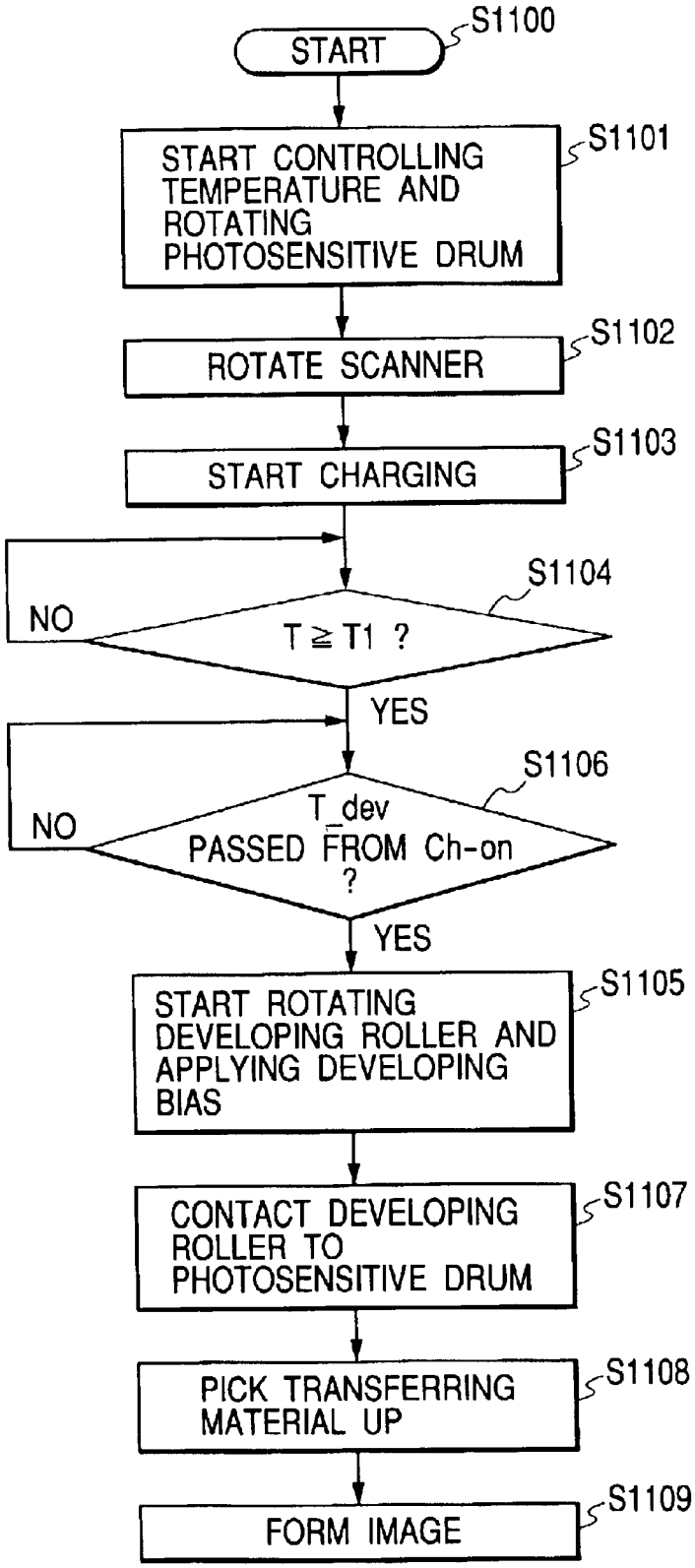
FIG. 11 is a flow chart representing operations of the image forming apparatus in accordance with the fourth embodiment of the present invention.
Figure 18:
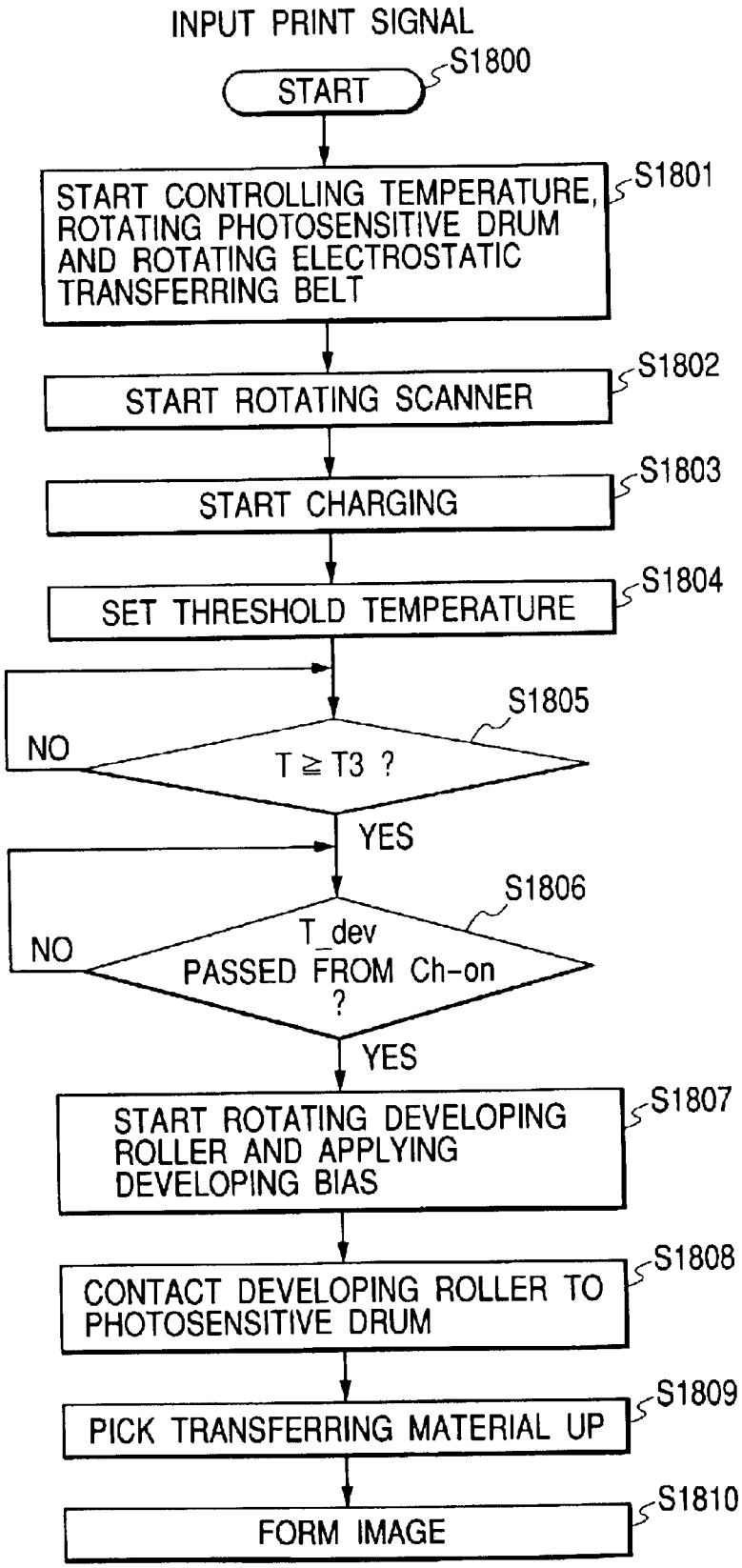
FIG. 18 is a flow chart representing operations of the image forming apparatus in accordance with the seventh embodiment of the present invention.
Figure 19:
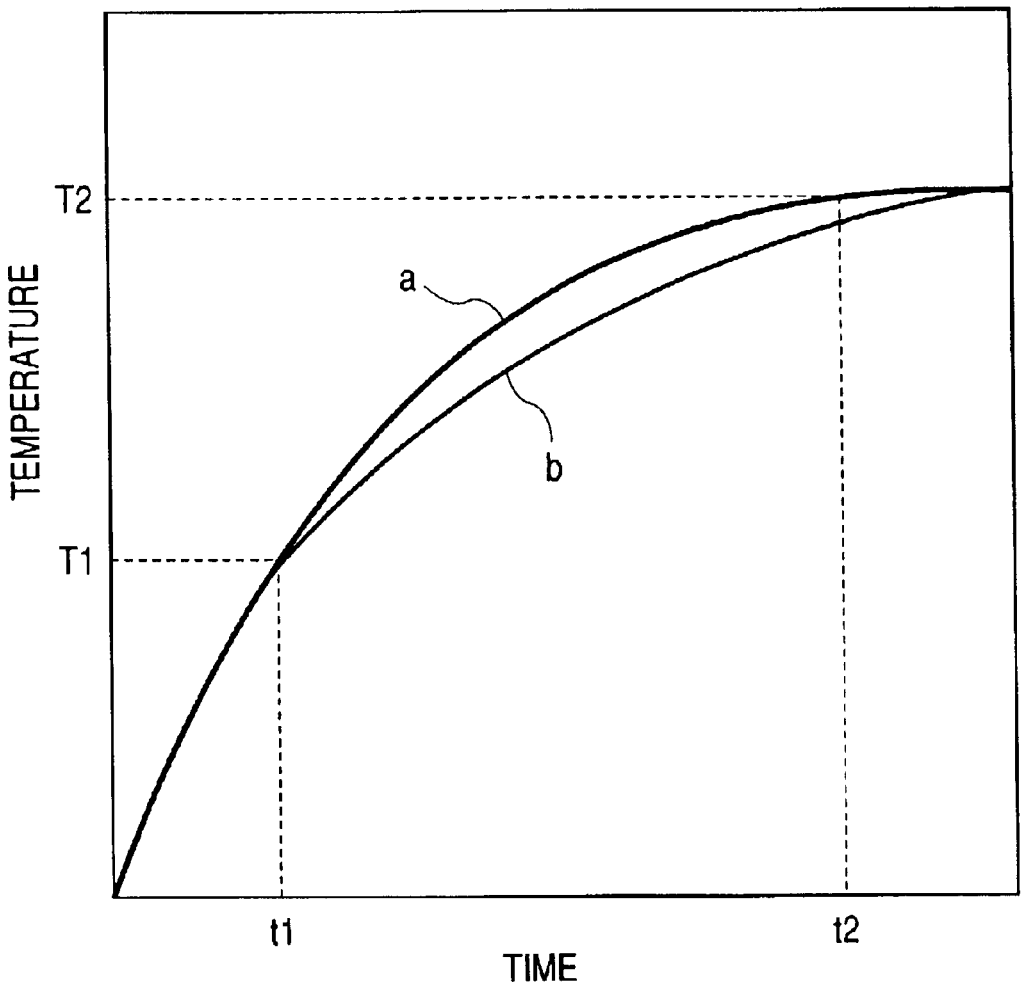
FIG. 19 is a graph showing temperature rising curves at a normal voltage value and a lower limit voltage value.

A timing chart of the image forming operation of this embodiment is the same as that shown in FIG. 10. The image forming operation of this embodiment will be hereinafter described with reference to a schematic sectional view of FIG. 17, a timing chart of FIG. 10 and a flow chart of FIG. 18.

When the operation of the image forming apparatus is started by the input of a print signal in an image forming apparatus main body (Start, S1800), first, the CPU 17 starts fixing temperature control for controlling the fixing device 14 to a predetermined temperature, rotation of the photosensitive drums 1 (1*a*, 1*b*, 1*c* and 1*d*) and rotation of the electrostatic transferring belt 21 as a first sequence group (Heat-on, S1801). Next, after passing a predetermined time duration, the CPU 17 starts rotating the scanner units 3 (3*a*, 3*b*, 3*c* and 3*d*) (Scan-on, S1802). Here, start-up timing is staggered because, if four motors for driving the photosensitive drums 1 (1*a*, 1*b*, 1*c* and 1*d*), one motor for driving the electrostatic transferring belt 21 and four scanner motors are simultaneously started up, it is likely that a capacity of the power supply is exceeded. At this point, the developing rollers 40 (40*a*, 40*b*, 40*c* and 40*d*) remain stopped.

Next, the CPU 17 starts applying a charging bias at a predetermined time after the photosensitive drums 1 (1*a*, 1*b*, 1*c* and 1*d*) start rotation for prevention of a memory (Ch-on, S1803).

Then, after setting the threshold temperature T3 for starting up the second sequence group with the same method as the first embodiment (S1804), the CPU 17 continues to monitor the temperature T of the fixing device 14 and, when the temperature T has reached T3 (S1805), judges if T_dev has passed from Ch-on when the temperature T has reached T3 (S1806). The CPU 17 starts rotating the developing rollers 40 (40*a*, 40*b*, 40*c* and 40*d*) and applying a developing bias after waiting for T_dev to pass if T_dev has not passed from Ch-on when the temperature T has reached T3 or, immediately starts rotating the developing rollers 40 (40*a*, 40*b*, 40*c* and 40*d*) and applying a developing bias if T_dev has already passed from Ch-on when the temperature T has reached T3 (Dev-on, S1807). After Dev-on, the CPU 17 causes the developing rollers 40 (40*a*, 40*b*, 40*c* and 40*d*) to come into contact with the photosensitive drum 1 after a predetermined time with Dev-on as a reference (D_R-on, S1808), and then picks a transferring material up (P-pick, S1809) to form an image (Print, S1810).

If an image forming operation for forming an image on a transferring material is started after temperature rising of a fixing device is completed as in the conventional image forming apparatus, FPOT requires approximately twenty-one seconds. On the other hand, in the image forming apparatus according to this embodiment can reduce FPOT to approximately seventeen seconds.

In the case of a 100 V input at a normal temperature (22.5° C.), it requires approximately twelve seconds for a fixing device to reach fixable temperature. On the other hand, in the case of a 85 V input at a lower temperature (15° C.), it requires approximately sixteen seconds for the fixing device to reach the fixable temperature. Therefore, in the conventional method that does not take into account a temperature rising curve of the fixing device, it should always be assumed that sixteen seconds is required such that an image can be surely fixed even under hardest conditions such as a low temperature and a lower limit voltage. This means that there is always excess four seconds even at the time of normal use.

Thus, as in this embodiment, the CPU 17 monitors a temperature of the fixing device 14 to find a temperature rising curve of the fixing device 14 and set the threshold temperature T3 for starting up the second sequence group based on the temperature rising curve, and then judges if the temperature of the fixing device 14 has reached T3 to control timing for the second sequence group to start operations, that is, timing for starting rotating the developing rollers 40*a*, 40*b*, 40*c* and 40*d* and applying a developing bias in this embodiment, depending on a result of the judgement. Then, it is possible to accurately match timing of completion of temperature rising of the fixing device 14 and timing of reaching of the transferring material P to the fixing device 14 even if the image forming apparatus is placed under any situation. Therefore, FPOT can be always made shortest in any situation wherever the image forming apparatus is placed, and unnecessary rotation of a developing device can be controlled. Moreover, since it is also possible to control an unnecessary heating time of the fixing device 14, the present invention is also effective for energy saving.

Further, the image forming apparatus in accordance with the present invention is not limited to the above-mentioned embodiments but can be modified in various ways within the scope of the prevent invention.

1) That is, although the photosensitive drum and the developing roller of the process cartridge are driven by separate motors in each of the above-mentioned embodiments, a method may be used which divides a driving force from one motor utilizing a gear and a clutch.

2) In addition, another method may be used such as using a cam rather than the parting plate 23.

3) Although a temperature rising curve is judged from a time when a temperature of the fixing device is changed from the predetermined temperature T1 to the predetermined temperature T2 in each of the above-mentioned embodiments, the temperature rising curve may be judged from an amount of change of temperature that has change during a predetermined time interval or a rate of change of temperature per unit time may be used.

4) In addition, start-up timing of the fixing device, the photosensitive drum and the scanner or timing of contact of the developing roller and pick-up of a transferring material may be in any order other than the above-mentioned order.

5) Although the scanner of an image scanning system is used in each of the above-mentioned embodiments, it is needless to mention that an exposure device using an LED array may be used. In this case, since a warm-up operation as in a scanner is unnecessary, start-up timing is different from that of a scanner.

6) Moreover, the present invention can also be applied to a color image forming apparatus provided with a plurality of developing devices for one photosensitive drum, which is well known in the past, other than the color image forming apparatus of a tandem type.

7) The image forming apparatus is not limited to an apparatus of a transfer system but may be an image forming apparatus of a direct system that uses photosensitive paper, electrostatic recording paper and the like as a material to be recorded and forms and bears a toner image directly on them.

8) The image forming process is not limited to the electrophotographic process that uses a photosensitive body but may be an electromagnetic recording process using a dielectric body as an image bearing member, a magnetic recording process using a magnetic body, and the like.

While the described embodiment represents the preferred for the present invention, it is to be understood that modifications will occur to those skilled in that art without departing from the spirit of the invention. The scope of the invention is therefore to be determined solely by the appended claims.

What is claimed is:

1. An image forming apparatus comprising:

developing means having a developing roller;

fixing means for heat-fixing a toner image formed on a transferring material;

detecting means for detecting a temperature of said fixing means;

first control means for controlling a power supplied to said fixing means in accordance with the detected temperature; and second control means for controlling a timing for starting a rotation operation of the developing roller in which the developing roller abuts an image bearing member in accordance with the detected temperature.

2. An image forming apparatus according to claim 1, wherein said second control means starts the rotation operation of said developing roller and makes the developing roller abut the image bearing member at a time when the detected temperature of said fixing means reaches a threshold temperature.

3. An image forming apparatus according to claim 2, further comprising determining means for determining said threshold temperature based on a temperature increasing situation of said fixing means.

4. An image forming apparatus according to claim 3, wherein said determining means determines said threshold temperature based on at least one of a time when temperature of said fixing means reaches a second set temperature from a first set temperature, and an amount of temperature increase of said fixing means during a period from a first set time to a second set time.

5. An image forming apparatus according to claim 1, wherein rotation of a photosensitive drum or application of a charging bias is started at a timing based on the detected temperature.

6. An image forming apparatus according to claim 1, wherein the timing for starting rotation operation of the developing roller and the timing for which the developing roller abuts the image bearing member are varied depending on a rising speed of the detected temperature.

7. An image forming apparatus according to claim 1, wherein image formation on a material to be recorded and temperature rising of said fixing means are performed in parallel.

8. An image forming apparatus according to claim 1, wherein said image forming apparatus is a color image forming apparatus for forming a color image by performing changing, exposure and development for a plurality of times.

9. An image forming apparatus according to claim 1, wherein said fixing means is a quick start fixing device.

10. An image forming apparatus according to claim 1, wherein said fixing means is started to be heated simultaneously with print start or preheated prior to the print start.

11. An image forming apparatus comprising:

developing means having a developing roller that is brought into contact with and parted from an image bearing member;

transferring means for transferring an image formed on said image bearing member to a transferring material;

fixing means for heat-fixing a toner image formed on the transferring material;

detecting means for detecting a temperature of said fixing means; and control means for controlling said developing means and said fixing means, wherein said control means starts heating of said fixing means with said developing roller parted from said image bearing member and drives said developing roller to rotate and to come into contact with said image bearing member at timing based on a temperature detected by said detecting means.

12. An image forming apparatus according to claim 11, wherein said control means starts rotating said image bearing member or applying a charging bias member at timing based on a temperature detected by said detecting means.

13. An image forming apparatus according to claim 11, wherein said image forming apparatus is a color image forming apparatus for forming a color image by performing an image forming process for a plurality of times.

14. An image forming apparatus according to claim 11, wherein said fixing means is a fixing device of a film heating system.

15. An image forming apparatus according to claim 11, wherein said image bearing member is a photosensitive drum and an image is formed thereon using an electrophotographic process.

16. A method of controlling an image forming apparatus including developing means having a developing roller that is brought into contact with and parted from an image bearing member, transferring means for transferring an image formed on said image bearing member to a transferring material, fixing means for heat-fixing a toner image formed on the transferring material, detecting means for detecting a temperature of said fixing means, and control means for controlling said developing means and said fixing means, the method comprising the steps of:

starting heating of said fixing means prior to image formation with said developing roller parted from said image bearing member;

judging whether or not to drive said developing roller to rotate and to come into contact with said image bearing member based on a temperature detected by said detecting means; and driving said developing roller to rotate and to come into contact with said image bearing member based on the judgment in said judging step.

17. A method of controlling an image forming apparatus according to claim 16, wherein said control means starts at least one of rotating said image bearing member and applying a charging bias at timing based on a temperature detected by said detecting means.

18. A method of controlling an image forming apparatus according to claim 16, wherein said image forming apparatus is a color image forming apparatus for forming a color image by performing charging, exposure and developing for a plurality of times.

19. A method of controlling an image forming apparatus according to claim 16, wherein said fixing means is a fixing device of a film heating system.

20. A method of controlling an image forming apparatus according to claim 16, wherein said image bearing member is a photosensitive drum and an image is formed thereon using an electrophotographic process.

21. An image forming apparatus comprising:

a developing device including a developing roller;

a heat fixing member configured to effect heat-fixing of a toner image formed on a transferring material;

a temperature detector configured to detect a temperature of said heat fixing member;

a power controller configured to control power supplied to said fixing member in accordance with the temperature detected by said temperature detector; and a timing controller configured to control a timing for starting a rotation operation of the developing roller in accordance with the temperature detected by said temperature detector.

22. An image forming apparatus according to claim 21, wherein said timing controller starts the rotation operation of the developing roller at a time when the temperature of said heat fixing member detected by said temperature detector reaches a threshold temperature.

23. An image forming apparatus according to claim 22, further comprising a processor configured to determined the threshold temperature based on a temperature increasing rate of said heat fixing member.

24. An image forming apparatus according to claim 23, wherein said processor is configured to determine the threshold temperature on at least one of a time when a temperature of said heat fixing member reaches a second set temperature from a first set temperature and an amount of temperature increase of said heat fixing member during a period from a first set time to a second set time.

25. An image forming apparatus according to claim 21, wherein one of a rotation of a photosensitive drum and an application of a charging bias is started at a timing based on the temperature detected by said temperature detector.

26. An image forming apparatus according to claim 21, wherein the timing for starting a rotation operation of the developing roller is varied depending on a rising speed of the temperature detected by said temperature detector.

27. An image forming apparatus according to claim 21, wherein image formation on a material to be recorded and temperature rising of said heat fixing member are performed in parallel.

28. An image forming apparatus according to claim 21, wherein said image forming apparatus is a color image forming apparatus having a plurality of developing devices for forming a color image.

29. An image forming apparatus according to claim 21, wherein said heat fixing member is a quick start fixing device.

30. An image forming apparatus according to claim 21, wherein said heat fixing member is heated simultaneously with print start or preheated prior to the print start.

31. An image forming apparatus comprising:

a developing member including a developing roller contactable with an image bearing member;

a transferring belt configured to transfer a toner image formed on the image bearing member to a transferring material;

a heat fixing member configured to effect heat-fixing of the toner image on the transferring material;

a temperature detector configured to detect a temperature of said heat fixing member; and a controller configured to control said developing member and said heat fixing member, wherein said controller starts heating of said heat fixing member with the developing roller out of contact with said image bearing member and drives said developing roller to rotate and to come into contact with said image bearing member at timing based on a temperature detected by said temperature detector prior to image formation.

32. An image forming apparatus according to claim 31, wherein said controller starts one of a rotating of said image bearing member and an applying of a charging bias at a timing based on a temperature detected by said temperature detector.

33. An image forming apparatus according to claim 31, wherein said image forming apparatus is a color image forming apparatus having a plurality of developing members for forming a color image by performing an image forming process a plurality of times.

34. An image forming apparatus according to claim 31, wherein said heat fixing member is a fixing member of a film heating system.

35. An image forming apparatus according to claim 31, wherein said image bearing member is a photosensitive drum and an image is formed thereon using an electrophotographic process.

36. A method of controlling an image forming apparatus comprising a developing member including a developing roller that is contactable with an image bearing member, a transferring belt configured to transfer a toner image formed on the image bearing member to a transferring material, a heat fixing member for heat-fixing the toner image formed on the transferring material, a temperature detector for detecting a temperature of said fixing member, and a controller configured to control the developing member and the fixing member, the method comprising the steps of:

starting heating of the heat fixing member prior to image formation with the developing roller out of contract with the image bearing member;

judging whether to drive the developing roller so as to rotate the developing roller and bring the developing roller into contact with the image bearing member based on a temperature detected by the temperature detector; and driving the developing roller to rotate and to bring the developing roller into contact with the image bearing member based on the judgment in said judging step.

37. A method of controlling an image forming apparatus according to claim 36, wherein at least one of a rotating the image bearing member and an applying of a charging bias at a timing based on a temperature detected by the temperature detector is started.

38. A method of controlling an image forming apparatus according to claim 36, wherein the image forming apparatus is a color image forming apparatus for forming a color image by performing charging, exposing and developing a plurality of times.

39. A method of controlling an image forming apparatus according to claim 36, wherein the heat fixing member is a fixing device of a film heating system.

40. A method of controlling an image forming apparatus according to claim 36, wherein the image bearing member is a photosensitive drum and an image is formed thereon using an electrophotographic process.

* * * * *

UNITED STATES PATENT AND TRADEMARK OFFICE

CERTIFICATE OF CORRECTION

PATENT NO. : 6,952,540 B2
APPLICATION NO. : 10/210063
DATED : October 4, 2005
INVENTOR(S) : Akihiko Uchiyama It is certified that error appears in the above-identified patent and that said Letters Patent is hereby corrected as shown below:

ON THE COVER PAGE:

On the cover page, in item "(56) References Cited," under "FOREIGN PATENT DOCUMENTS," the first listed document "51-109739 1/1975" should read -- 51-109739 1/1976--.

COLUMN 7:

Line 35, "supported to" should read -- supported by --.
Line 62, "of them" should be deleted.

COLUMN 8:

Line 59, "can 20" should read -- cam 20 --.
Line 62, "can 20" should read -- cam 20 --.

COLUMN 10:

Line 40, "rotation" should read -- rotations --.
Line 59, the first occurrence of "a" should read -- the --.

COLUMN 15:

Line 11, "T dev" should read -- T_dev --.

COLUMN 17:

Line 1, "At" should read -- Δt --.
Line 3, "At." should read -- Δt. --.

COLUMN 21:

Line 34, "preferred" should read -- preferred embodiment --.

Signed and Sealed this

Fifth Day of December, 2006

JON W. DUDAS
*Director of the United States Patent and Trademark Office*